US007134227B2

(12) United States Patent
Quenzi et al.

(10) Patent No.: US 7,134,227 B2
(45) Date of Patent: Nov. 14, 2006

(54) ADJUSTABLE WING PLOW

(75) Inventors: Philip J Quenzi, Atlantic Mine, MI (US); Cal G Niemela, Chassell, MI (US); Nels A Niemela, Chassell, MI (US)

(73) Assignee: Douglas Dynamics, L.L.C., Milwaukee, WI (US)

( * ) Notice: Subject to any disclaimer, the term of this patent is extended or adjusted under 35 U.S.C. 154(b) by 71 days.

(21) Appl. No.: 10/835,429

(22) Filed: Apr. 29, 2004

(65) Prior Publication Data

US 2004/0216333 A1 Nov. 4, 2004

Related U.S. Application Data

(60) Provisional application No. 60/467,712, filed on May 2, 2003.

(51) Int. Cl.
*E01H 5/04* (2006.01)

(52) U.S. Cl. ..... 37/274; 37/234; 37/261; 172/815; 172/786

(58) Field of Classification Search ..... 37/281, 37/274, 241, 282, 283, 234, 232, 266, 279, 37/903; 172/782, 786, 815, 816, 684.5
See application file for complete search history.

(56) References Cited

U.S. PATENT DOCUMENTS

| | | | | |
|---|---|---|---|---|
| 595,202 | A | 12/1897 | Pearson et al. | |
| 1,927,078 | A | 9/1933 | Weeks | 37/44 |
| 2,218,512 | A | 10/1940 | Ball | 37/42 |
| 2,299,451 | A | 10/1942 | Austin | 37/44 |
| 2,410,543 | A | 11/1946 | Kester | 37/44 |
| 2,524,329 | A | 10/1950 | Richardson | 37/44 |
| 2,643,470 | A | 6/1953 | Kaeser | |
| 3,157,099 | A | 11/1964 | Ulrich | |
| 3,250,026 | A | 5/1966 | Jocher et al. | 37/42 |
| 3,302,317 | A | 2/1967 | Domres | 37/179 |
| 3,378,084 | A | 4/1968 | Ulrich | 172/247 |
| 3,425,497 | A | 2/1969 | Strabala et al. | 172/792 |
| 3,430,706 | A | 3/1969 | Marron | 172/802 |
| 3,477,151 | A | 11/1969 | Zanella | 37/42 |
| 3,657,828 | A | 4/1972 | Anderson | 37/46 |
| 3,775,877 | A | 12/1973 | Gove, Sr. | 37/42 |

(Continued)

FOREIGN PATENT DOCUMENTS

DE 919474 7/1949

(Continued)

OTHER PUBLICATIONS

*Farm Industry News*, vol. 23, No. 7, Jul./Aug. 1990, p. 25.

(Continued)

*Primary Examiner*—Thomas A Beach
(74) *Attorney, Agent, or Firm*—Wood, Herron & Evans, L.L.P.

(57) ABSTRACT

A plow assembly includes a pair of plow wings which are pivotally mounted at opposite ends of a center plow. Each of the plow wings may pivot between a forwardly angled position and an aligned position. The plow assembly may pivot a trailing plow wing in response to the center plow being urged or angled toward that side of the vehicle. The plow wings may be oriented in their forwardly angled position until the center plow is at least substantially urged or pivoted toward its angled position or toward a position between the center position and the angled position. The trailing plow wing may be pivoted or urged to its aligned position in response to the center plow being substantially urged or pivoted toward its angled position or toward a position between its center position and its angled position.

60 Claims, 18 Drawing Sheets

U.S. PATENT DOCUMENTS

| | | | | |
|---|---|---|---|---|
| 3,803,733 | A | 4/1974 | Ramsey | 37/44 |
| 3,807,064 | A | 4/1974 | Schmidt, Jr. | 37/41 |
| 4,019,268 | A | 4/1977 | Waterman | 37/10 |
| 4,073,077 | A | 2/1978 | Essel et al. | 37/50 |
| 4,074,448 | A | 2/1978 | Niemela | 37/41 |
| 4,099,578 | A | 7/1978 | Stevens | 172/802 |
| 4,145,825 | A | 3/1979 | Bertolino | 37/42 |
| 4,196,532 | A | 4/1980 | Muller | 37/105 |
| 4,249,323 | A | 2/1981 | Mathis et al. | 37/42 |
| 4,275,514 | A | 6/1981 | Maura | 37/42 |
| RE31,045 | E | 10/1982 | Essell et al. | 37/281 |
| 4,356,645 | A | 11/1982 | Hine et al. | 37/281 |
| 4,369,847 | A | 1/1983 | Mizunuma | 172/815 |
| 4,372,617 | A | 2/1983 | Zamboni | 229/24 |
| 4,479,312 | A | 10/1984 | Turgeon | 31/219 |
| 4,614,048 | A | 9/1986 | Melby | 37/280 |
| 4,658,519 | A | 4/1987 | Quenzi | 37/23 |
| 4,667,426 | A | 5/1987 | Howard et al. | 37/232 |
| 4,723,609 | A | 2/1988 | Curtis | 172/815 |
| 4,779,363 | A | 10/1988 | Boutrais et al. | 37/117 |
| 4,834,191 | A | 5/1989 | Vecchio | 172/784 |
| 4,962,600 | A | 10/1990 | Zellaha et al. | 37/280 |
| 5,165,191 | A | 11/1992 | Davis | 37/117.5 |
| 5,285,588 | A | 2/1994 | Niemela et al. | 37/234 |
| 5,375,349 | A | 12/1994 | Jochim | 37/429 |
| 5,392,538 | A | 2/1995 | Geerligs et al. | 37/268 |
| 5,411,102 | A | 5/1995 | Nickels et al. | 172/781 |
| 5,638,618 | A | 6/1997 | Niemela et al. | 37/281 |
| 5,829,174 | A | 11/1998 | Hadler et al. | 37/234 |
| 5,899,007 | A | 5/1999 | Niemela et al. | 37/281 |
| 5,903,986 | A * | 5/1999 | Parker | 37/281 |
| 6,178,669 | B1 | 1/2001 | Quenzi et al. | 37/231 |
| 6,276,076 | B1 | 8/2001 | Quenzi et al. | 37/231 |
| 6,393,737 | B1 | 5/2002 | Quenzi et al. | 37/231 |
| 6,408,549 | B1 | 6/2002 | Quenzi et al. | 37/281 |
| 6,412,199 | B1 | 7/2002 | Quenzi et al. | 37/281 |
| 6,442,877 | B1 | 9/2002 | Quenzi et al. | 37/281 |
| 6,463,683 | B1 * | 10/2002 | Skwarchuk | 37/280 |
| 6,615,513 | B1 | 9/2003 | Quenzi et al. | 37/231 |

FOREIGN PATENT DOCUMENTS

| | | |
|---|---|---|
| EP | 140139 | 5/1985 |
| GB | 1037674 | 8/1966 |
| SE | 323974 | 5/1970 |

OTHER PUBLICATIONS

Publication "Still Out Front in Productivity," Excel Industries, Inc., ® 1988.

"Snow Track 440," Publication, Excel Industries, 1989.

* cited by examiner

ADJUSTABLE WING PLOW

CROSS REFERENCE TO RELATED APPLICATION

The present application claims benefit of U.S. provisional application, Ser. No. 60/467,712, filed May 2, 2003, which is hereby incorporated herein by reference in its entirety.

FIELD OF THE INVENTION

The present invention relates generally to plow assemblies for mounting to a vehicle and for pushing or moving snow, dirt, sand, gravel and/or other plowable material and, more particularly, to a plow assembly having plow wings which are adjustable between a straight or aligned position generally parallel to a main or center mold board or plow of the plow assembly and a forwardly angled position for limiting the plowed material from slipping off the ends of the main or center plow of the plow assembly.

BACKGROUND OF THE INVENTION

It is known to provide pivotable plow wings at one or both ends of a main plow of a plow assembly for a vehicle. Examples of such plow assemblies are shown in U.S. Pat. Nos. 6,408,549; 6,442,877; and 6,412,199, which are hereby incorporated herein by reference. The plow wings may be adjustable via actuation of corresponding actuators and may be adjustable independently of a position or orientation of the main or center plow. It is also known to provide a plow assembly with plow wings which each move between a forwardly angled position, where the plow wing is angled forwardly from the main plow, and an aligned position, where the plow wing is generally aligned with the main plow. The plow wings may pivot between their positions in response to pivotal movement of the main plow relative to the vehicle. Such a snowplow assembly is disclosed in U.S. Pat. No. 3,477,151, issued to Zanella on Nov. 11, 1969.

SUMMARY OF THE INVENTION

The present invention is intended to provide a plow assembly with pivotable and adjustable plow wings at opposite ends of a main or center plow. The plow wings are adjustable between a forwardly angled position and a generally aligned position relative to the center plow. Each plow wing may be pivotable in response to the center plow being pivoted toward the side of the respective plow wing. The plow wings may be biased toward their forwardly angled positions and may only move to their generally aligned position when the center plow has been fully or substantially or at least partially pivoted toward the side of the respective plow wing.

According to an aspect of the present invention, a plow assembly for a vehicle includes a center plow having first and second ends, a support for attaching the plow assembly to the vehicle, first and second plow wings and a wing pivoting system. The center plow is pivotable relative to the vehicle between a first position, where the center plow is pivoted toward the first end, and a second position, where the center plow is pivoted toward the second end. Each of the first and second plow wings is pivotally mounted at a respective one of first and second ends of the center plow and is pivotable between an angled position, where the plow wing is angled forwardly with respect to the center plow, and an aligned position, where the plow wing is generally aligned with the center plow. The first and second plow wings are biased toward the angled positions via at least one biasing member. The wing pivoting system is operable to pivot the first plow wing toward the aligned position in response to the center plow being pivoted toward the first position, and to pivot the second plow wing toward the aligned position in response to the center plow being pivoted toward the second position. The wing pivoting system includes at least one connecting member which is connected to the first and second plow wings and to the support. The connecting member or members is/are configured to move the first plow wing toward the aligned position as the center plow is pivoted toward the first position and to allow the first plow wing to move toward the angled position in response to the biasing member as the center plow is pivoted away from the first position. Likewise, the connecting member or members is/are configured to move the second plow wing toward the aligned position as the center plow is pivoted toward the second position and to allow the second plow wing to move toward the angled position in response to the biasing member as the center plow is pivoted away from the second position.

The at least one connecting member may comprise at least one cable connected to the first and second plow wings and to the support. The cable may connect to a lever arm at each of the first and second plow wings to pivot at least one of the lever arms relative to the center plow to correspondingly pivot the respective plow wing, such as via a connecting linkage connected between the lever arm and the plow wing. The cable may move outwardly relative to the lever arm to allow the respective plow wing to pivot toward the angled position in response to the at least one biasing member when the center plow is pivoted away from its first or second position.

According to another aspect of the present invention, a plow assembly for a vehicle includes a center plow, a support for attaching the center plow to the vehicle, a first plow wing on the first end of the center plow and a second plow wing on the second end of the center plow. The center plow is pivotable relative to the vehicle between a first position, where the center plow is pivoted toward the first end, and a second position, where the center plow is pivoted toward the second end. Each of the plow wings is pivotally mounted to a respective one of the ends of the center plow and is pivotable between an angled position, where the plow wing is angled forwardly with respect to the center plow, and an aligned position, where the plow wing is generally aligned with the center plow. A first biasing member is connected between the main plow and the first plow wing and a second biasing member is connected between the main plow and the second plow wing. Each of the biasing members is selectively mounted at the main plow and/or the plow wing in one of at least two mounting positions. The biasing member is selectively mounted in a first mounting position to position the respective plow wing in the aligned position and in a second mounting position to position the respective plow wing in the angled position. The biasing members is compressible to absorb an impact of the respective plow wing with an object during operation of the plow assembly.

According to another aspect of the present invention, a plow assembly for a vehicle includes a center plow having first and second ends, a support for attaching the plow assembly to the vehicle, a first plow wing at the first end of the center plow, and an actuating or wing pivoting system. The center plow is pivotable relative to the vehicle between a first position, where the center plow is angled toward the first end, and a center position, where the center plow is positioned generally normal to the direction of travel of the vehicle. The first plow wing is pivotally mounted at the first end of the center plow and is pivotable between an angled position, where the plow wing is angled forwardly with respect to the center plow, and an aligned position, where the plow wing is generally aligned with the center plow. The actuating system is operable to urge the first plow wing toward the angled position until the center plow is urged at least substantially toward one of the first position and a position between the first and center positions. The actuating system urges the first plow wing toward the aligned position in response to the center plow being urged at least substantially toward the first position or the position between the first and center positions.

The plow assembly may include a second plow wing at the second end of the center plow. The actuating system may also be operable to pivot the second plow wing to its aligned position in response to the center plow being at least substantially urged toward a second position (where the center plow is pivoted toward the second end) or a position between the second and center positions. The actuating system may also urge each of the plow wings toward their angled positions in response to the center plow being at least partially urged toward the opposite side.

The actuating system may comprise a hydraulic system that includes at least one plow actuator for urging or pivoting the center plow to the first and second positions, and first and second wing actuators for urging or pivoting the first and second plow wings, respectively, relative to the center plow. The first and second wing actuators may be biased to bias the plow wings toward their angled positions. The wing actuators may be biased via a biasing pressure within the actuators which is greater than a fluid pressure applied to the plow actuators to urge or pivot the center plow between the first and second positions. The biasing pressure at the first or second wing actuator may be overcome as the pressure at a corresponding one of plow actuators increases as the center plow is urged or pivoted at least substantially toward its first or second position.

According to another aspect of the present invention, a plow assembly for a vehicle includes a center plow having first and second ends, a support for attaching the center plow to the vehicle, a first plow wing pivotally mounted to the first end of the center plow, and an actuating system. The center plow is pivotable relative to the vehicle between a first position, where the center plow is pivoted toward the first end, and a center position, wherein the center plow is positioned generally normal to the direction of travel of the vehicle. The first plow wing is pivotable between an angled position, where the first plow wing is angled forwardly with respect to the center plow, and an aligned position, where the first plow wing is generally aligned with the center plow. The actuating system comprises at least one plow actuator operable to pivot the center plow between the first and center positions and a first wing actuator operable to pivot the first plow wing between the angled and aligned positions.

In one form, the plow actuator is operable to urge the center plow toward the first position in response to a first pressure being applied to the plow actuator, while the first wing actuator is operable to urge the first plow wing toward the aligned position in response to a second pressure being applied to the first wing actuator. The first pressure is less than the second pressure, such that the center plow is at least substantially urged toward the first position or a position between the first and center positions before the first plow wing is urged toward the aligned position.

In another form, the first wing actuator is operable to urge the first plow wing toward the aligned position in response to a first pressure being applied to the first wing actuator, while the plow actuator is operable to urge the center plow toward the first position in response to a second pressure being applied to the plow actuator. The first pressure is less that the second pressure, such that the first plow wing is at least substantially urged toward the aligned position before the center plow is urged toward the first position.

According to yet another aspect of the present invention, a plow assembly for a vehicle includes a center plow having first and second ends, and a first plow wing on the first end of the center plow. The center plow is mountable to the vehicle and is pivotable relative to the vehicle between a first position, where the center plow is pivoted toward the first end, and a center position, where the center plow is positioned generally normal to the direction of travel of the vehicle. The first plow wing is pivotally mounted to the first end of the center plow and is pivotable between an angled position, where the first plow wing is angled forwardly with respect to the center plow, and an aligned position, where the first plow wing is generally aligned with the center plow. The first plow wing is biased toward the angled position and is pivotable toward the aligned position in response to a load against the first plow wing in a direction generally along the center plow at least when the center plow is angled toward the first position.

Therefore, the present invention provides a plow assembly with pivotable plow wings which are pivotable in response to a pivotal movement of a main or center plow toward one side or the other. The trailing plow wing (or the plow wing which is at the end of the center plow toward which the center plow is pivoted or angled) may pivot toward and to its aligned position after the center plow has been pivoted or urged at least partially or substantially toward its fully angled or pivoted position, such that both of the plow wings may remain in their forwardly angled positions throughout most of the pivotable range of motion of the center plow. The plow wings may be biased toward their angled positions, in order to maintain the plow wings in their angled positions until the biasing force exerted on the trailing plow wing is overcome as the center plow pivots to the respective sidewardly angled or pivoted position. The plow wings may pivot in response to a cable pulling at a portion of the plow wings and pulling against the biasing force exerted at the plow wings to pivot the respective plow wing toward its aligned position as the center plow pivots or angles toward the respective plow wing. Optionally, the trailing plow wing may pivot toward its aligned position in response to initial pivoting or urging of the center plow or in response to actuation of an actuating system of the plow assembly, such that the plow wing pivots to its generally aligned position before substantial pivotal movement of the center plow occurs. The actuators for pivoting the plow wings may be operable in response to less hydraulic fluid or less hydraulic pressure than the plow actuators for pivoting the center plow, such that each plow wing may move or pivot to its aligned position before the center plow moves or pivots toward the respective sidewardly angled or pivoted position.

These and other objects, advantages, purposes and features of the present invention will become apparent upon review of the following specification in conjunction with the drawings.

DESCRIPTION OF THE PREFERRED EMBODIMENTS

Figure 1:
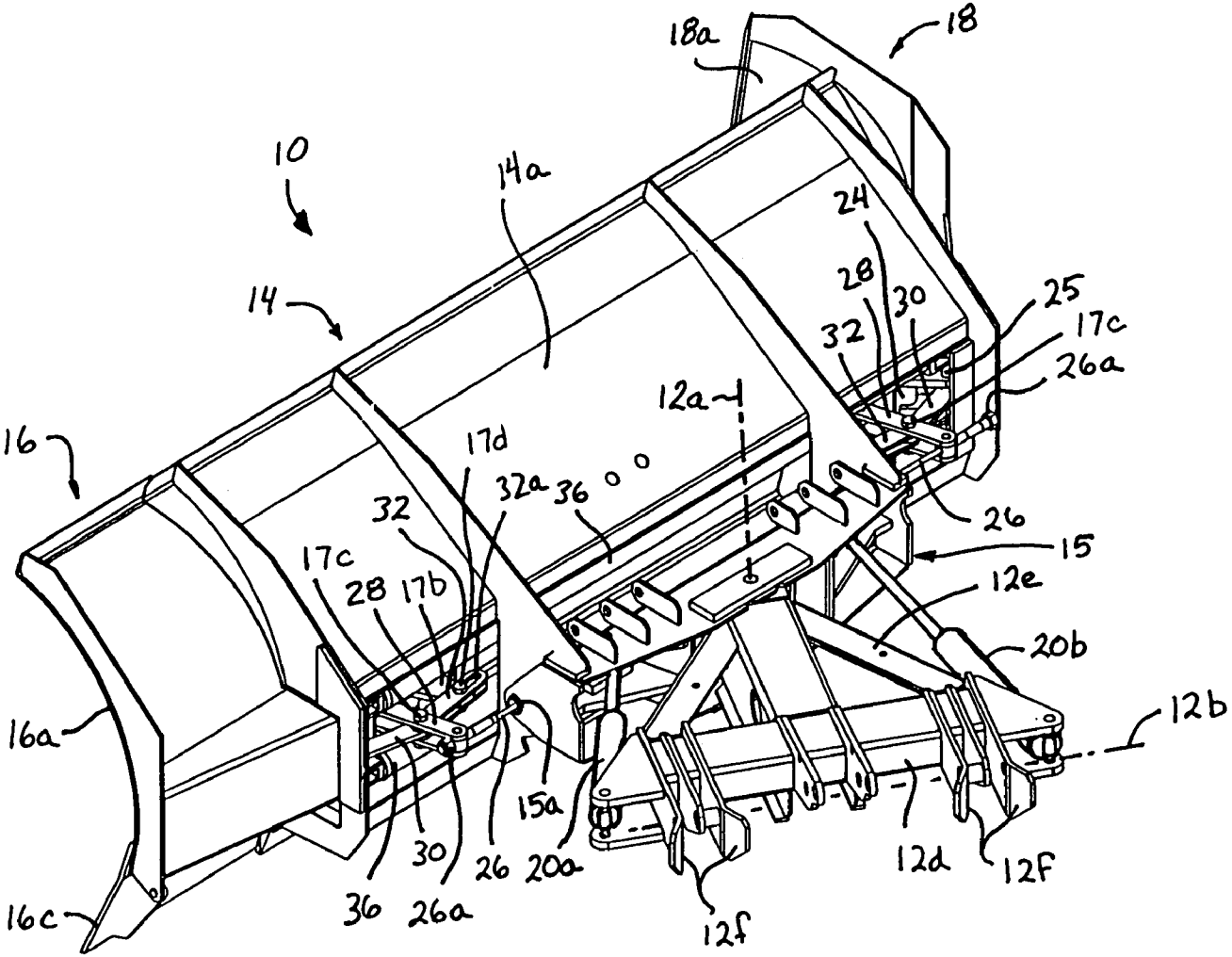
FIG. 1 is a rear perspective view of a plow assembly in accordance with the present invention, with the plow assembly being mountable to a vehicle via an A-frame support.

Referring now specifically to the drawings and the illustrative embodiments depicted therein, a plow assembly 10 is mounted to a push beam or the like (not shown) on a vehicle (also not shown) via a support 12, such as an A-frame support or the like (FIG. 1). Plow assembly 10 may be mounted to support 12 via an intermediate support 15 at a rear portion of a main or center plow 14 of plow assembly 10. Intermediate support 15 may be pivotally mounted to support 12 and may be pivotable toward one side or the other about a generally vertical pivot axis 12*a*, while support 12 may be pivotally mounted to the push beam assembly and may be pivotable about a generally horizontal axis 12*b* to raise or lower the plow with respect to the vehicle. Plow assembly 10 includes opposite plow wings 16, 18 pivotally mounted at opposite ends of the center plow 14. Plow assembly 10 also includes a wing pivoting system or actuating system 22, which is operable to pivot one or both of the plow wings 16, 18 relative to center plow 14 in response to pivoting of center plow 14 about pivot axis 12*a*, as discussed below.

Figures 8, 19:
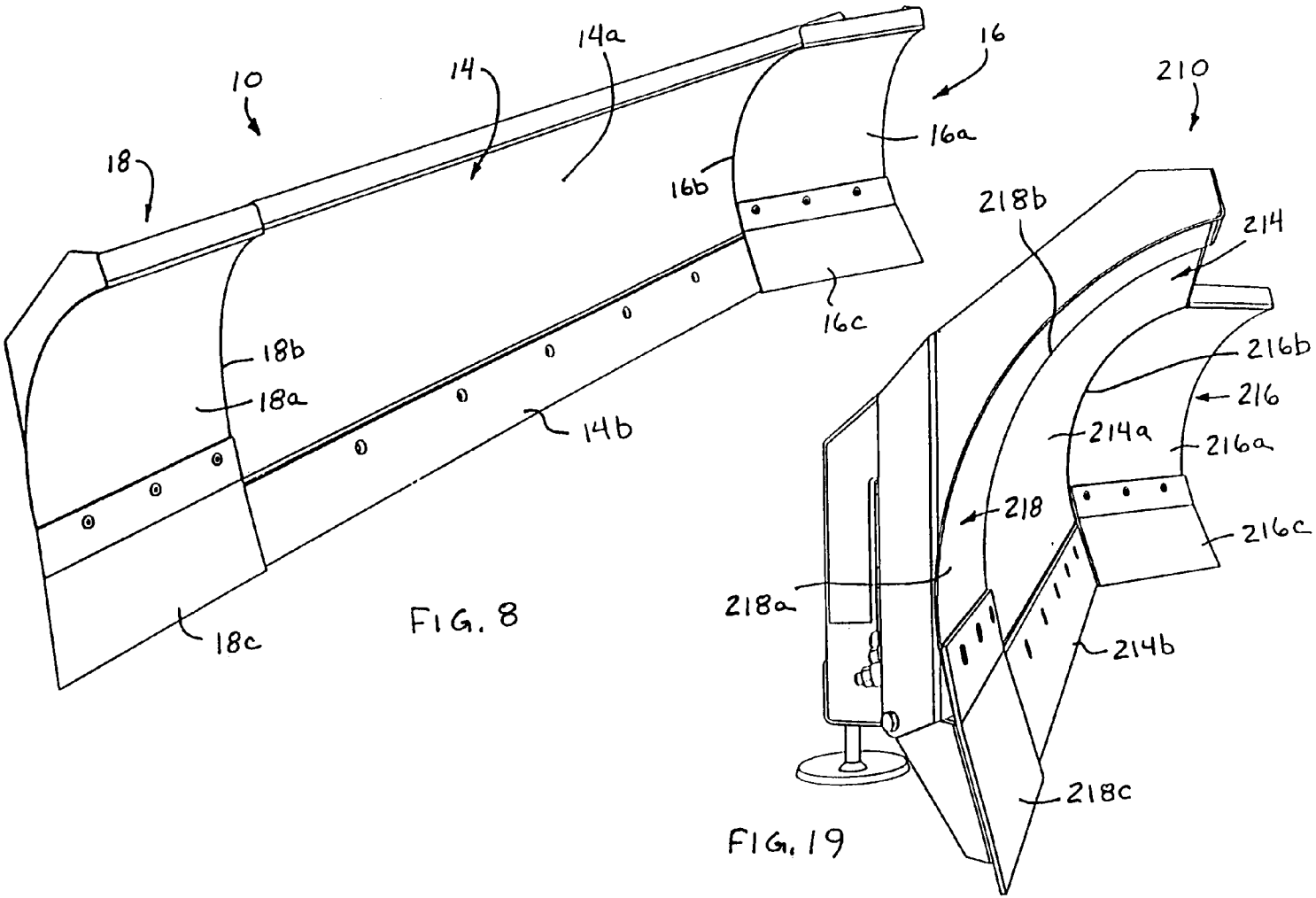
FIG. 8 is a perspective view of the front of the plow assembly of FIGS. 1–6.
FIG. 19 is a perspective view of the front and side of the plow assembly of FIGS. 15–18.

As best shown in FIGS. 1 and 8, main or center plow 14 may include a main curved mold board or material engaging surface 14*a* and a plow blade 14*b* for pushing or plowing snow, dirt, sand, gravel and/or other plowable material as the center plow 14 is moved through the snow or other material by the vehicle. Center plow 14 may also include mounting bracket or intermediate support 15 for pivotally mounting center plow 14 to a forward end of support 12.

Plow assembly 10 may be mounted to a push beam assembly of any vehicle, such as a pickup truck or the like, via support 12. The plow assembly 10 may be pivotable toward the right or left side of the vehicle, such as via a pair of plow angling actuators 20*a*, 20*b*, such as hydraulic cylinders or the like, which may correspondingly extend and retract to pivot the main or center plow about vertical pivot axis 12*a* at a forward end 12*c* (FIGS. 4 and 6) of support 12. As center plow 14 pivots toward one side of the support 12 and the vehicle, such as toward the left side as shown in FIG. 1, the wing pivoting device or system 22 may be operable to pivot the trailing plow wing, such as the left plow wing 16 in FIG. 1, toward its generally aligned position in response to center plow 14 pivoting toward that side of the vehicle, as discussed below.

Support frame 12 may be any type of support frame or mounting means, such as the A-frame support of the illustrated embodiment or such as known or conventional mounting arms, frames or supports or the like, without affecting the scope of the present invention. As shown in FIG. 1, support frame 12 may be of the type suitable for attachment to a push beam or the like at a front of a pickup truck or the like, and may include a triangular-shaped or A-frame shaped reinforced frame work having a base 12*d* and inwardly tapering sides 12*e* and spaced pairs of rearwardly extending support flanges 12*f* on base 12*d*. The support flanges 12*f* may be configured and arranged to allow support 12 to be secured to a suitable hitch assembly or the like on the front of a pickup truck or other vehicle, while allowing pivotal movement of support 12, and thus of the plow assembly, about horizontal pivot axis 12*b* extending through the support flanges 12*f*. Plow angling actuators 20*a*, 20*b* may mount at opposite ends of base 12*d* and extend forwardly to connect to the mounting bracket or intermediate support 15 of plow assembly 10. Extension of one actuator, such as the right actuator 20*b* in FIG. 1, and a corresponding retraction of the other hydraulic cylinder or actuator at the other side of support 12, causes pivotal movement of the intermediate support 15 and the main or center plow 14 about pivot axis 12*a* at the forward end 12*c* of support 12.

Figure 4:
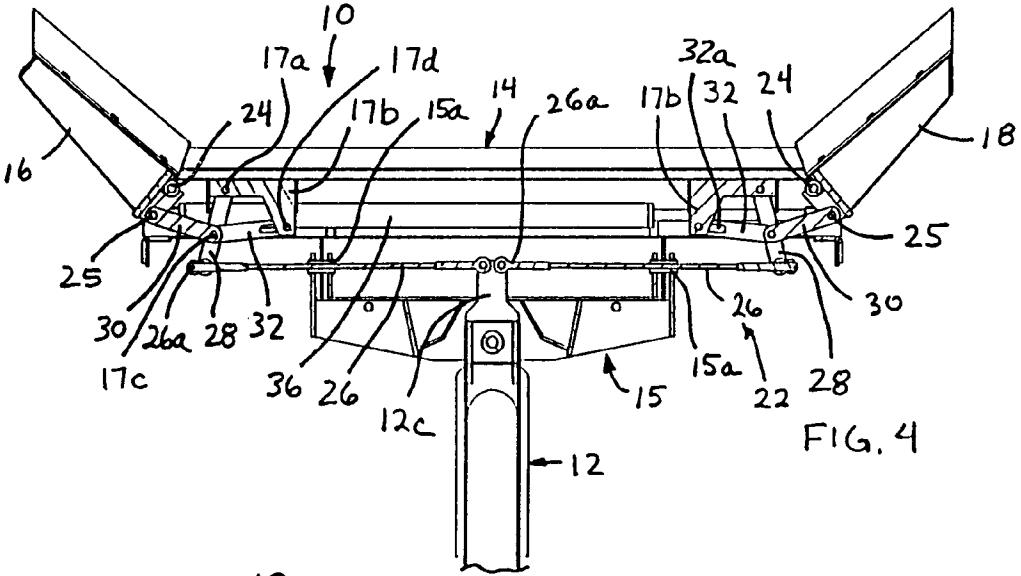
FIG. 4 is a partial sectional view of the plow assembly taken along the line A—A in FIG. 3.
Figure 6:
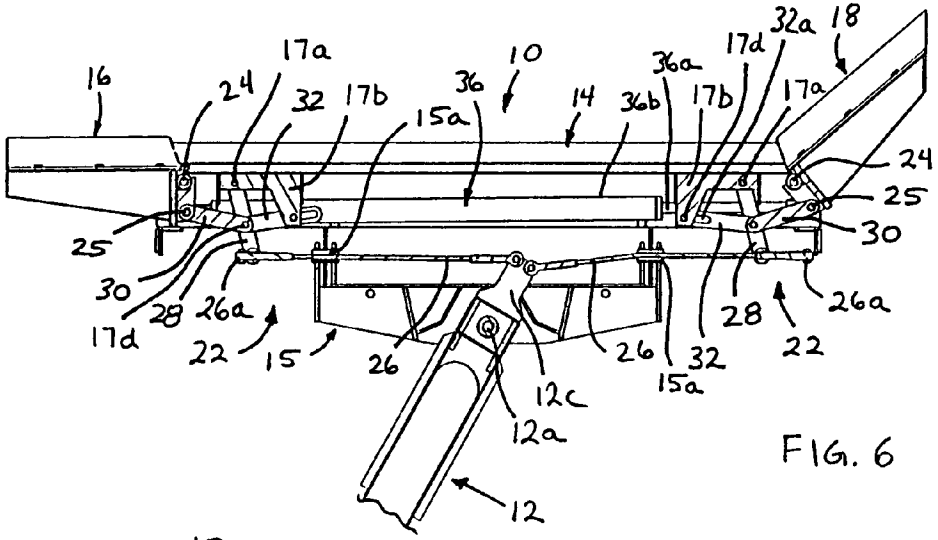
FIG. 6 is a partial sectional view of the plow assembly taken along the line B—B in FIG. 5.

As can be seen in FIGS. 4 and 6, support 12 includes the forward end or forwardly projecting portion 12*c*, which extends forwardly from pivot axis 12*a*. When center plow 14 is pivoted, forwardly projecting portion 12*c* may move or pivot toward the opposite side of the plow assembly from the side toward which the center plow is pivoted relative to support 12. The side to side movement of forwardly projecting portion 12*c* may function to move or drive or actuate the wing pivoting or adjusting device or system 22 as center or main plow 14 and intermediate support 15 are pivoted about pivot axis 12*a* relative to support 12, as discussed below.

Each plow wing 16, 18 may be pivotally mounted at a respective end of center plow 14 via a hinge or pivot axle 24. Plow wings 16, 18 are pivotable about their respective hinges 24 between their forwardly extended or angled positions (such as right plow wing 18 is shown in FIG. 1), and their generally aligned positions (such as left plow wing 16 is shown in FIG. 1). The plow wings 16, 18 may each include a curved material engaging surface or partial mold board 16*a*, 18*a* (FIGS. 1 and 8) for pushing the plowed material as plow assembly 10 is moved through the material by the vehicle. The partial mold boards 16*a*, 18*a* may partially overlap the mold board 14*a* of center plow 14, and may have curved inner edges 16*b*, 18*b* (FIG. 8), such that center plow 14 and plow wings 16, 18 maintain a generally uniform and continuous material engaging surface irrespective of the position or orientation of either of the plow wings relative to the center plow. As can be seen in FIG. 4, the hinges 24 may be positioned generally rearward of the material engaging surfaces 16*a*, 18*a*, 14*a* of the plow wings 16, 18 and center plow 14 so as to provide a substantially continuous plow surface. Each of the plow wings 16, 18 may also include a plow blade 16*c*, 18*c* (FIG. 8) along the lower edge of the wings.

When center plow 14 is in a generally straight or non-angled or center position, where the main or center plow is positioned generally normal to the direction of travel of the vehicle, both plow wings 16, 18 may be positioned in or biased toward their forwardly angled position, such that plow assembly 10 may form or define a generally U-shaped material engaging surface for pushing and carrying snow or other material as plow assembly 10 is moved through the snow or other material being plowed. When center plow 14 is angled toward one side of the vehicle, the plow wing that is toward the side of the vehicle or plow assembly toward which the center plow is angling (i.e. the trailing plow wing) may be pivoted to the generally aligned position or orientation in response to wing pivoting system 22, while the other plow wing (i.e. the leading plow wing) remains in the generally forwardly angled position. The angles of the plow wings at their forwardly angled positions may be selected such that when the center plow is tilted or angled toward its fully angled or tilted position toward one side of the vehicle, the leading plow wing (the plow wing at the end of the main plow which is opposite from the end toward which the main plow is angled) may be oriented generally along the direction of travel of the vehicle when in its forwardly angled position.

Figure 2:
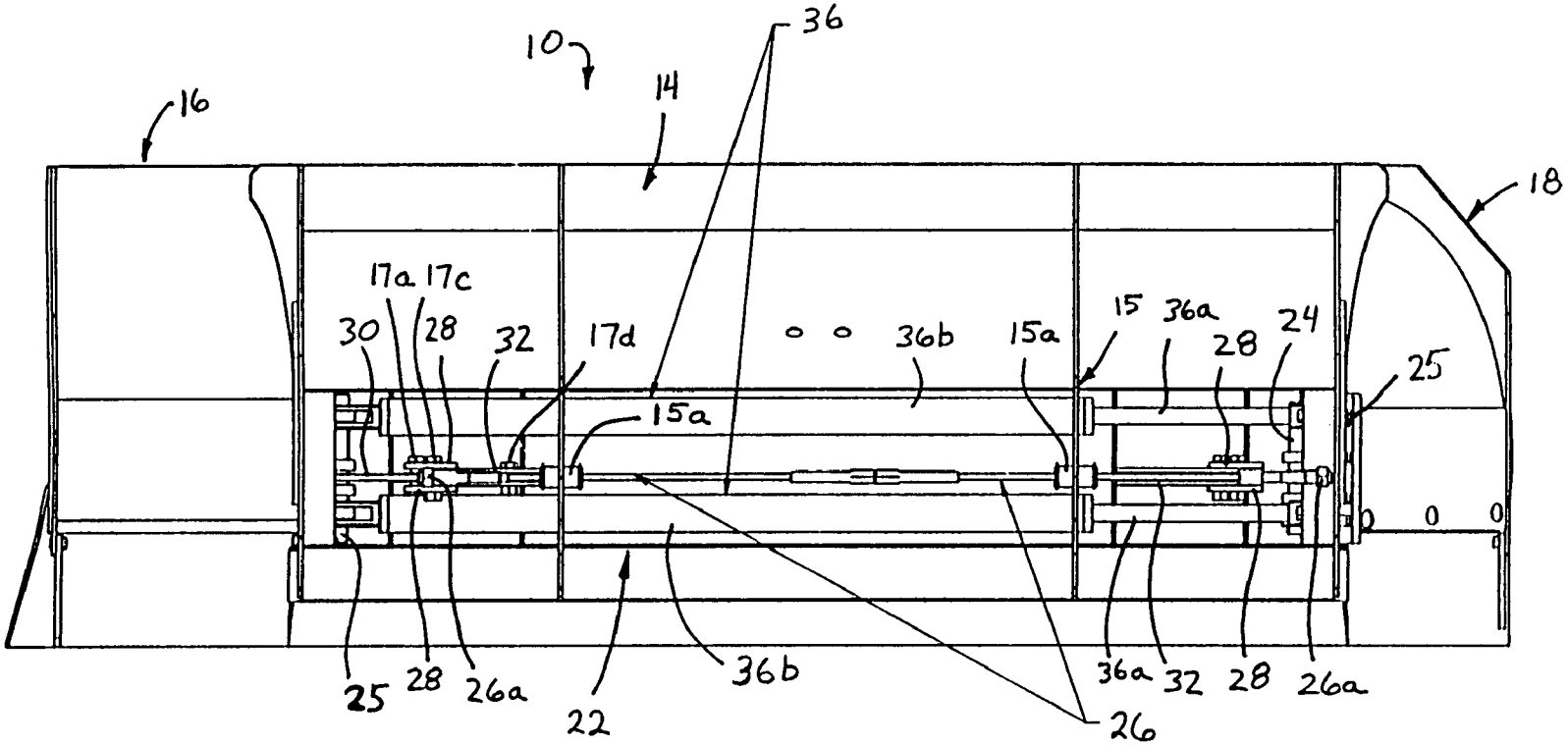
FIG. 2 is a rear elevation of the plow assembly of FIG. 1, with the A-frame support removed therefrom, and with the left plow wing pivoted toward its generally aligned orientation.

Plow wing pivoting system 22 may include one or more cables 26 which are connected at forwardly extending portion 12*c* of support 12 and which are movable in response to pivotal movement of center plow 14 about pivot axis 12*a*, in order to pull a respective plow wing toward its aligned position, as discussed below. As best shown in FIGS. 2, 4 and 6, cables 26 may be pivotally mounted at forward extending portion 12*c* of support 12 and may extend laterally outwardly therefrom and through a bushing or the like 15*a* at intermediate support or bracket 15. An outer end 26*a* of each cable 26 may be slidably received through an outer end of a lever or pivot arm 28 (or between spaced apart pivot arms 28 as shown in the illustrated embodiment). Pivot arm or arms 28 may be pivotally mounted at a rear portion of center plow 14, such as via a pin, bolt or fastener 17*a* at a mounting portion or bracket 17*b* of center plow 14, and may extend rearwardly therefrom. As best shown in FIGS. 1, 4 and 6, each pivot arm 28 (such as each pair of spaced apart pivot arms) may be pivotally connected to a plow wing connecting link 30 and a main plow connecting link or pair of spaced connecting links 32 via a pin or bolt or fastener 17*c*. Plow wing connecting link 30 may be connected to a rear portion or bracket or pin or axle 25 of the respective plow wing, and main plow connecting link 32 (or spaced apart connecting links 32, such as shown in the illustrated embodiment) may be slidably connected to mounting portion 17*b*, such as via a slotted opening 32*a* and a pin, bolt or fastener or the like 17*d*.

Figure 7:
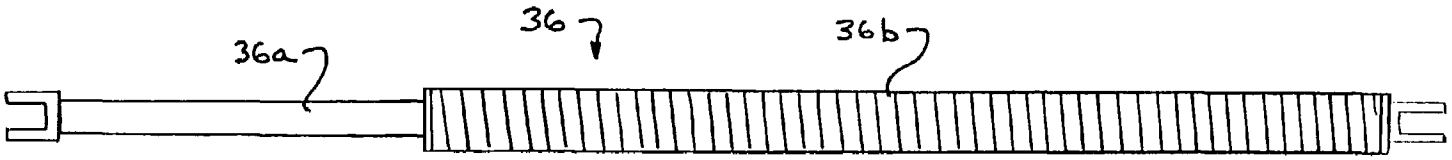
FIG. 7 is a side elevation of a biasing member or rod useful with the plow assembly of FIGS. 1–6.

Each plow wing 16, 18 may be biased toward the forwardly angled position via at least one biasing member or element 36 (FIG. 2). In the illustrated embodiment, each of a pair of biasing members 36 includes a spring loaded rod or shaft which may extend along the rear portion of main plow 14 and may connect at its opposite ends to the rearward mounting portion or pin or axle 25 of plow wings 16, 18. As shown in FIGS. 2 and 7, the spring loaded rod or biasing element 36 may include a cylindrical rod portion 36*a* and a spring loaded portion 36*b*, which biases the rod portion 36*a* toward an extended position or orientation, to bias or urge the plow wings toward their forwardly angled position about their respective pivot axles 24.

As can be seen with reference to FIGS. 4 and 6, pivotal movement of center plow 14 about pivot axis 12*a* may cause one of the cables 26 to pull against one of the pivot arms 28, which in turn pulls against the rear portion 25 of the respective plow wing via connecting link 30 to pivot the plow wing relative to center plow 14 about its pivot axis 24 and toward its generally aligned position. As pivot arm 28 is pulled by cable 26, the plow connecting link 32 may slide along a slotted opening which connects plow connecting link 32 to mounting portion 17*b* of center plow 14. The other cable 26 may slide outwardly relative to its respective pivot arm 28 to allow the other plow wing to remain in the forwardly angled position in response to biasing member or element 36.

Figure 3:
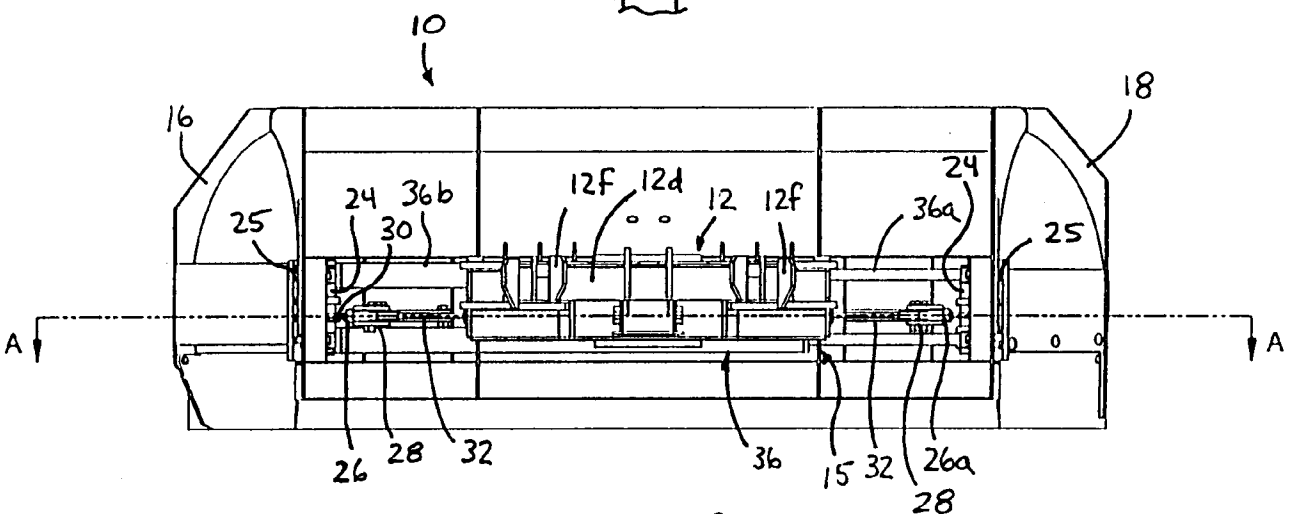
FIG. 3 is a rear elevation of the plow assembly of FIG. 1, with both plow wings angled toward their forwardly angled position.

Accordingly, when main or center plow 14 of plow assembly 10 is positioned in its generally straight or non-angled orientation, such as shown in FIGS. 3 and 4, biasing members 36 may apply or exert a biasing force at plow wings 16, 18 to urge plow wings 16, 18 toward their forwardly angled orientation about their pivot axes 24. The length of cables 26, pivot arms 28 and connecting links 30, 32 may be selected and arranged such that when center plow 14 is in its generally straight or non-angled position relative to support 12, cables 26 do not pull inwardly against either pivot arm 28, whereby both plow wings 16, 18 are in their fully forwardly angled position in response to biasing members 36. As can be seen in FIG. 4, plow assembly 10 thus defines a generally U-shaped plow, with both plow wings 16, 18 angled forwardly to their angled positions.

Figure 5:
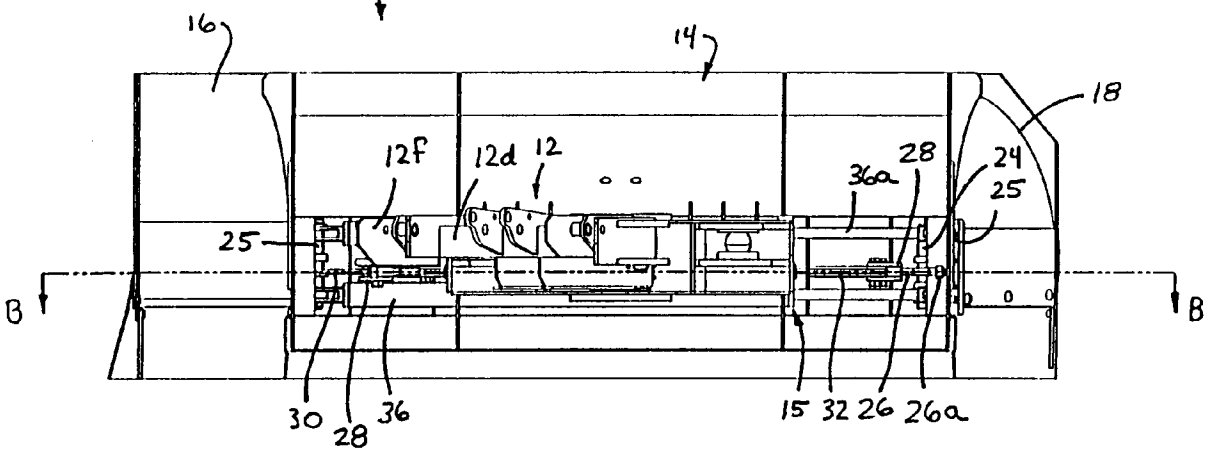
FIG. 5 is another rear elevation of the plow assembly similar to FIG. 3, with the center plow angled toward the left side with respect to the A-frame support, and with the left plow wing pivoted toward its generally aligned orientation.

When center plow 14 is angled or tilted toward one side or the other via actuators 20*a*, 20*b* (such as shown in FIGS. 1, 5 and 6), forward extending portion 12*c* of support 12 pivots or moves toward the opposite side of the plow assembly, such that forward extending portion 12*c* pulls at cable 26 on the trailing side of center plow 14, which in turn pulls at pivot arm 28 to pivot the trailing plow wing (such as plow wing 16 in FIGS. 1, 2, 5 and 6) toward its generally aligned position. The other cable 26 may slide outwardly relative to the bushing 15*a* at intermediate support 15 and relative to mounting arm 28, such that the opposite or leading plow wing (such as plow wing 18 in FIGS. 1, 2, 5, and 6) may remain angled towards its forwardly angled position.

Figure 9:
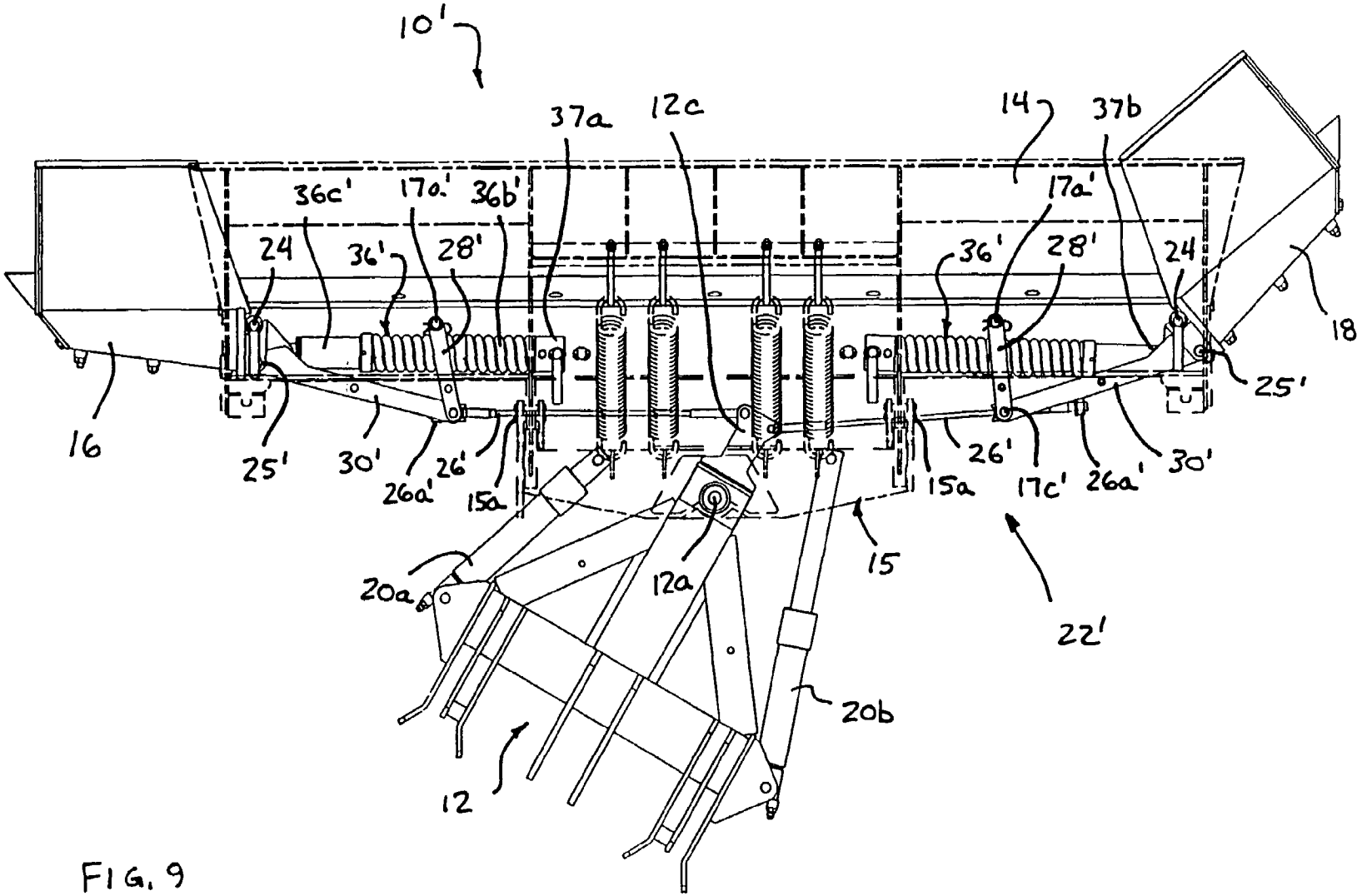
FIG. 9 is a top plan view of another plow assembly in accordance with the present invention, with the plow angled toward one side and the leading plow wing in its forwardly angled position.
Figure 10:
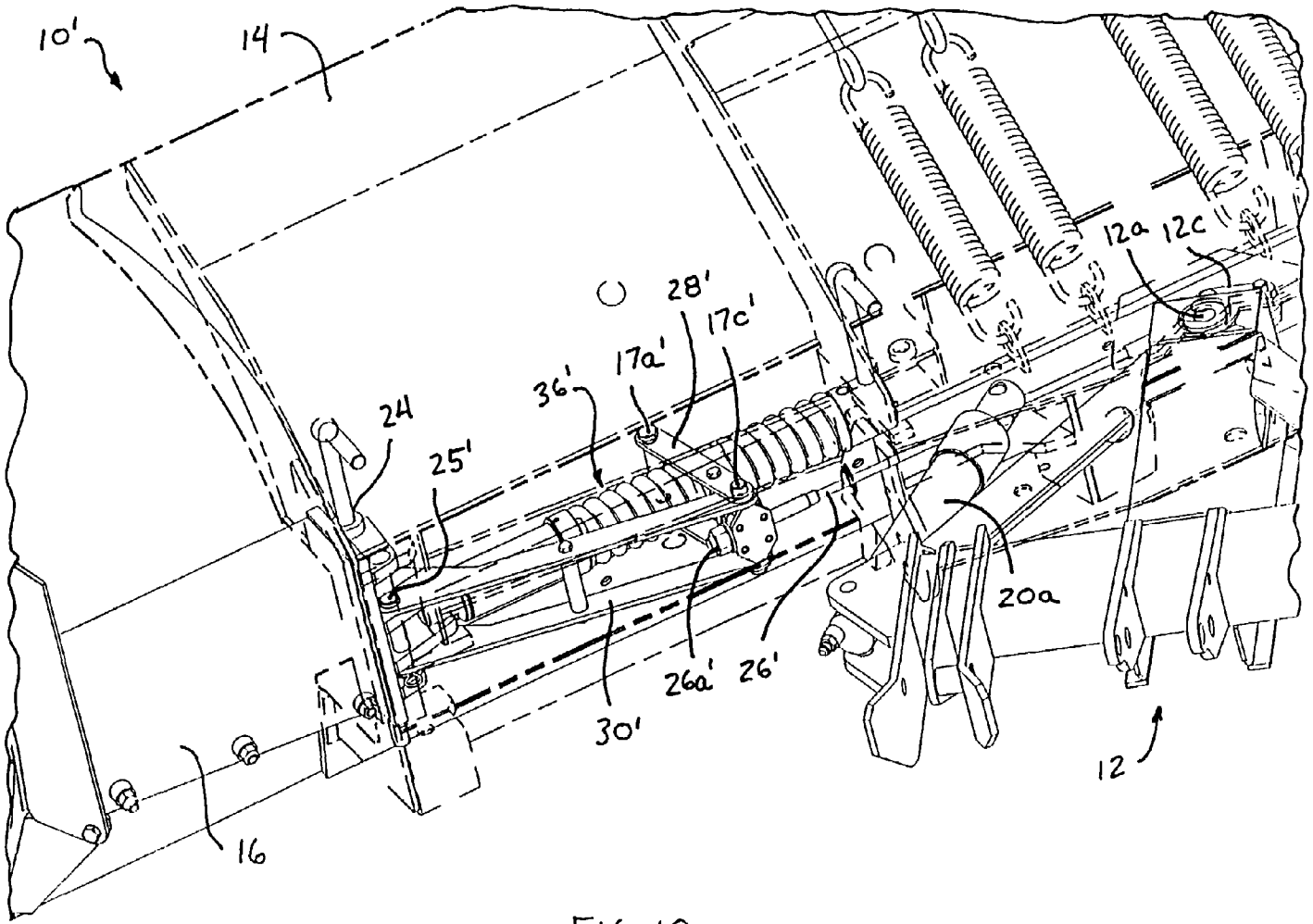
FIG. 10 is a perspective view of the cable and linkages at one side of the plow assembly of FIG. 9.

Referring now to FIGS. 9 and 10, a plow assembly 10' includes a wing pivoting system or actuating system 22', which is operable to pivot one or both of the plow wings 16, 18 in response to pivoting of the center plow 14 about the pivot axis 12*a*. Plow assembly 10' may be substantially similar to plow assembly 10, discussed above, such that a detailed discussion of the plow assembly and components thereof will not be repeated herein. The similar components are shown in the drawings with the same reference numbers for both plow assemblies 10, 10'. Similar to plow assembly 10, when center plow 14 of plow assembly 10' is in a generally straight or non-angled or center position, both plow wings 16, 18 may be positioned in or biased toward their forwardly angled position, and when center plow 14 is angled toward one side of the vehicle, the plow wing that is toward the side of the vehicle or plow assembly toward which the center plow is angling (i.e. the trailing plow wing) may be pivoted to its generally aligned position or orientation in response to wing pivoting system 22', while the other plow wing (i.e. the leading plow wing) remains in its generally forwardly angled position.

Plow wing pivoting system 22' may include one or more cables 26' connected at forwardly extending portion 12*c* of support 12 and movable in response to pivotal movement of center plow 14 about pivot axis 12*a*, in order to pull a respective plow wing toward its aligned position. Cables 26' may be pivotally mounted at forward extending portion 12*c* of support 12 and may extend laterally outwardly therefrom and through a bushing or the like 15*a* at intermediate support or bracket 15. An outer end 26*a*' of each cable 26' may be slidably received through an outer end of a lever or pivot arm 28' (or between spaced apart pivot arms 28', as can be seen in FIG. 10). Pivot arm or arms 28' may be pivotally mounted at a rear portion of main plow 14, such as via a pin, bolt or fastener 17*a*', and may extend generally rearwardly therefrom. As best shown in FIG. 10, each pivot arm 28' (such as each pair of spaced apart pivot arms) may be pivotally connected to a plow wing connecting link 30' (or pair of connecting links) via a pin or bolt or fastener 17*c*'. Plow wing connecting link 30' may be connected to a rear portion or bracket or pin 25' of the respective plow wing 16, 18, which is offset or spaced from the pivot axle or pin or axis 24 of the respective plow wing.

Figure 11:
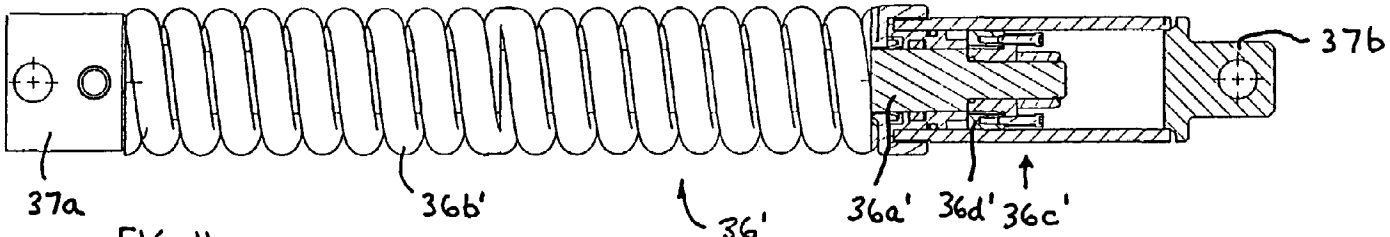
FIG. 11 is a side elevation and partial sectional view of a hydraulic spring and damper assembly useful with the plow assembly of FIGS. 9 and 10.

Each plow wing 16, 18 is biased toward its forwardly angled position via at least one biasing member or device 36'. Optionally, and as shown in FIGS. 9–11, the biasing member may comprise a spring/damper device 36' which may extend along one side of the rear portion of center plow 14 and may connect at one end 37*a* to the center plow 14 (such as to a bracket 27) and at its opposite end 37*b* to the respective rearward mounting portion or pin or axle 25' of plow wings 16, 18. End 37*a* may be removably attached at the center plow 14 and may be selectively attached at different mounting locations along the center plow 14, such as discussed below with respect to FIG. 14.

As shown in FIG. 11, each biasing device 36' may include a rod portion 36*a*', a biasing member or spring or spring element 36*b*' and an oil filled cylinder 36*c*'. The spring 36*b*' biases the rod portion 36*a*' toward an extended position or orientation to bias or urge the plow wing toward its forwardly extending position about its respective pivot axle 24. The oil filled cylinder or damper 36*c*' functions to control the speed of the plow wing's return during extension or decompression of the biasing device 36'. This may be accomplished via a check valve or orifice at a piston 36*d*' within cylinder 36*c*' that allows fluid within the cylinder 36*c*' to flow through the piston 36*d*' during compression of the biasing device 36' (which moves rod portion 36*a*' and piston 36*d*' relative to cylinder 36*c*'), but that restricts flow of fluid through the piston 36*d*' in the opposite direction or during decompression or extension of the biasing device 36'. Optionally, other types of biasing devices or elements that may or may not provide such a dampening function may be implemented, without affecting the scope of the present invention.

Similar to pivoting system 22, pivoting system 22' utilizes a cable 26' to pull against a pivot arm 28', which in turn pulls against the rear portion 25' of the respective plow wing via connecting link 30' to pivot the plow wing about its pivot axis 24 and toward its generally aligned position when the main or center plow is pivoted about its axis 12*a*. The other cable 26' may slide outwardly relative to its respective pivot arm 28' to allow the other plow wing to move to or remain in the forwardly angled position in response to biasing member or element 36'.

The linkage geometry and/or cable lengths and/or cable mounting location may be selected to commence pivoting of the plow wing toward the aligned position at a desired angle or degree of angling or trigger angle/position of the center plow, such that the plow wing may remain in its forward angled position until the center plow is angled or turned a particular or predetermined or desired degree or angle toward either side of center. For example, the cables and/or linkage geometry may be selected so that the plow wings remain in their forwardly angled positions until the center plow is angled approximately half of its full angle capability toward either side. When the center plow reaches the desired angle or trigger angle/position, the cable and linkage may begin pivoting the trailing plow wing and may pivot the plow wing toward its generally aligned position as the center plow is angled further toward that side (beyond the trigger angle). The linkage geometry may be set to commence pivoting of the plow wing at the desired angle or trigger point of the center plow and to provide full pivoting of the plow wing to its generally aligned position during the remaining angling range of the center plow. It is further envisioned that the mounting location of the cables at the linkages and/or at the forwardly extending portion of the support may be adjusted (such as via selectively mounting or attaching the cable at a selected one of two or more mounting openings or holes in the linkages and/or forwardly extending portion) to adjust the trigger angle as may be desired depending on the particular application of the plow assembly.

Accordingly, when main or center plow 14 of plow assembly 10' is positioned in its generally straight or non-angled orientation, biasing members 36' may apply or exert a biasing force at plow wings 16, 18 to urge plow wings 16, 18 toward their forwardly extending orientation about their pivot axes 24. The lengths of cables 26', pivot arms 28' and connecting links 30' may be selected and arranged such that when center plow 14 is in its generally straight or non-angled position relative to support 12, cables 26' may not pull inwardly against either pivot arm 28', whereby both plow wings 16, 18 may be in their fully forwardly angled position in response to biasing members 36'. When center plow 14 is angled or tilted toward one side or the other via actuators 20*a*, 20*b*, forward extending portion 12*c* of support 12 pivots or moves toward the opposite side of the plow assembly, such that forward extending portion 12*c* pulls at cable 26' on the trailing side of center plow 14, which in turn pulls at pivot arm 28' to pivot the trailing plow wing (such as plow wing 16 in FIGS. 9 and 10) toward its generally aligned position. The other cable 26' may slide outwardly relative to the bushing 15*a* at intermediate support 15 and relative to mounting arm 28', such that the opposite or leading plow wing (such as plow wing 18 in FIGS. 9 and 10) may remain angled towards its forwardly angled position. When the center plow is pivoted back toward its centered or non-angled position, the trailing plow wing may return to its forwardly angled position, and may return in a controlled or dampened manner.

Therefore, the plow wing pivoting system of the present invention may be configured to pivot the trailing plow wing toward and to its generally aligned position with respect to the main or center plow in response to pivotal movement of the center plow toward that side, while maintaining the leading plow wing in the forwardly angled position. It is further envisioned that the length of cable 26 and the length and arrangement of the pivot arms 28 and connecting links 30, 32 may be selected such that the trailing plow wing may remain in its forwardly angled position through much of the pivotal movement of the center plow, and may not pivot toward its generally aligned position until the center plow substantially angles or approaches or is substantially near an intermediate or trigger position or approaches or is substantially near its fully angled position toward that side.

Optionally, a plow assembly 110 (FIG. 12), 110' (FIG. 13) may include a biasing device 136, 136', respectively, for biasing the plow wings 116, 118 toward their forwardly angled positions. The biasing force or pressure exerted by the biasing device 136, 136' may be overcome by a force or load at one of the plow wings 116, 118 to pivot the plow wing to the aligned position. The force or load at the plow wing may be applied when the plow assembly is plowing material and while the center plow is angled at least partially toward the side of the respective plow wing, such that the trailing plow wing may pivot toward the aligned position. For example, a force or load exerted against the plow wing in a direction generally along the main or center plow may overcome the biasing force acting on the plow wing and may pivot or urge or push the plow wing toward its aligned position. The force may be from plowed material moving along the center plow (either when in its center position or angled position) or from the plow wing striking an object as the plow assembly is moved or driven by the vehicle.

Figure 12:
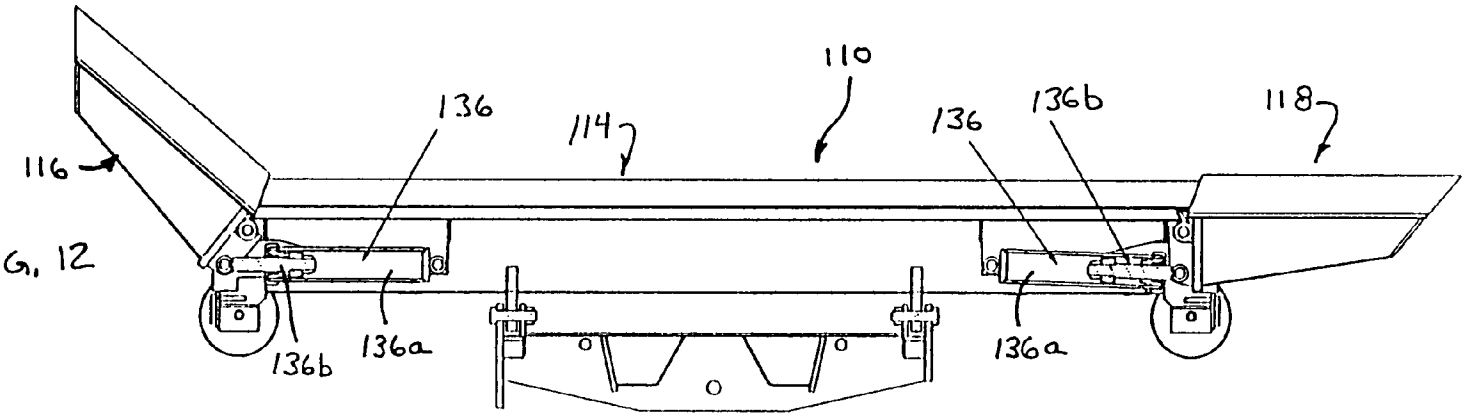
FIG. 12 is a top plan and partial sectional view of another plow assembly in accordance with the present invention.

In the illustrated embodiment of FIG. 12, biasing device 136 of plow assembly 110 comprises a pair of independent pressurized gas cylinders (one at each plow wing), which have pressurized gas within a head end portion 136*a* of the cylinder, such that the piston rod 136*b* of biasing device or cylinder 136 is biased outwardly toward an extended position to pivot or urge the respective plow wing toward the angled position. When the force at the plow wing is great enough to overcome the biasing pressure within biasing device 136, piston rod 136*b* may retract within the cylinder and compress the pressurized gas contained therein. When the load is removed from the plow wing, the pressurized gas functions to extend the piston rod to bias and return the plow wing to the angled position.

Figure 13:
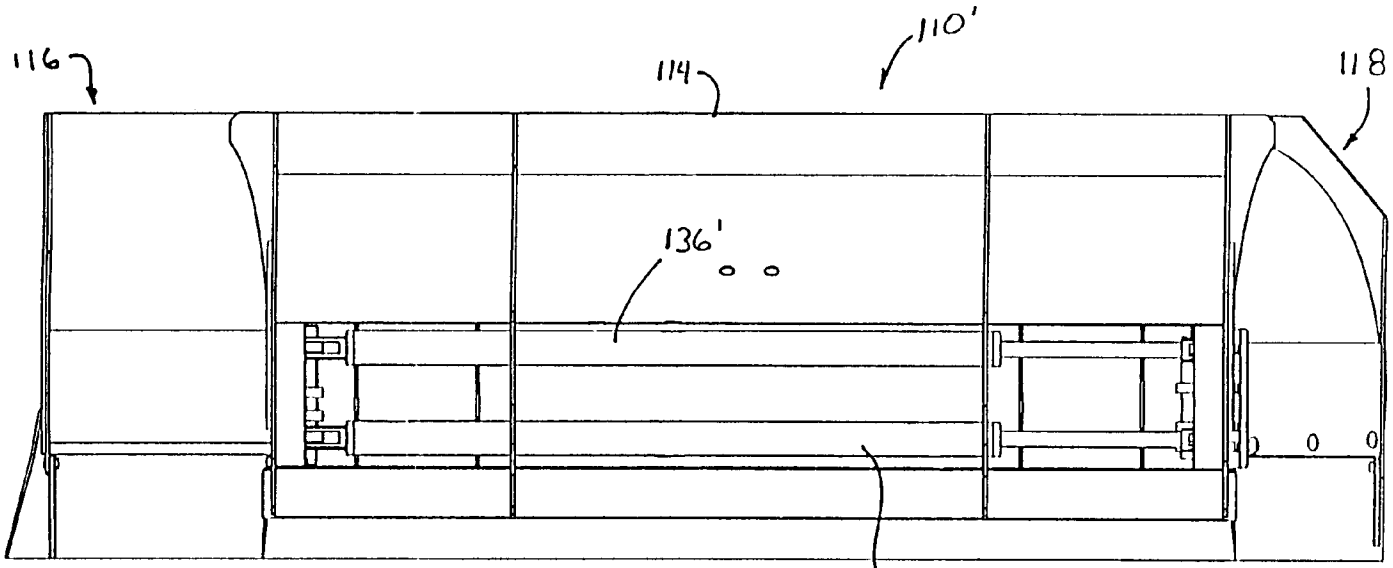
FIG. 13 is a rear elevation of another plow assembly in accordance with the present invention.

Optionally, as shown in FIG. 13, biasing device 136' of plow assembly 110' may comprise one or more spring loaded rods, such as rods similar to the spring loaded rods 36 discussed above with respect to plow assembly 10. The biasing devices or rods may be connected between the opposite plow wings to bias or urge both of the plow wings toward their forwardly angled positions. The biasing device 136' thus biases both plow wings 116, 118 toward their angled positions relative to the center plow 114. When a sufficient force is applied to one of the wings, one plow wing (such as the trailing wing when the center plow is angled toward that side) may pivot toward its aligned position as the force may overcome the biasing forces exerted by the biasing device. Because the biasing device is connected between both plow wings, as one of the plow wings is pivoted toward its aligned position, the biasing force applied to the other wing is increased to maintain the other plow wing in its forwardly angled position. The biasing device 136' thus may limit or substantially preclude pivoting of both plow wings toward their aligned positions, because the biasing force acting on one plow wing 118 may increase when the other plow wing 116 (such as the trailing plow wing) has been pivoted toward or to its aligned position.

Although shown and described as pressurized cylinders and/or spring loaded rods, it is envisioned that other biasing devices or members, such as springs or the like, may be implemented to bias one or both plow wings toward their angled positions relative to the center plow, without affecting the scope of the present invention. Optionally, the plow wings or biasing devices may be substantially locked when the main or center plow is positioned generally at the center position or orientation, such that the plow wings may not pivot toward their aligned position until the center plow is pivoted or angled toward that side. Each wing or biasing device may be mechanically latched or secured in its angled position and then unlatched or released in response to movement or urging of the center plow at least partially toward or substantially to its fully angled position at that side.

Figure 14:
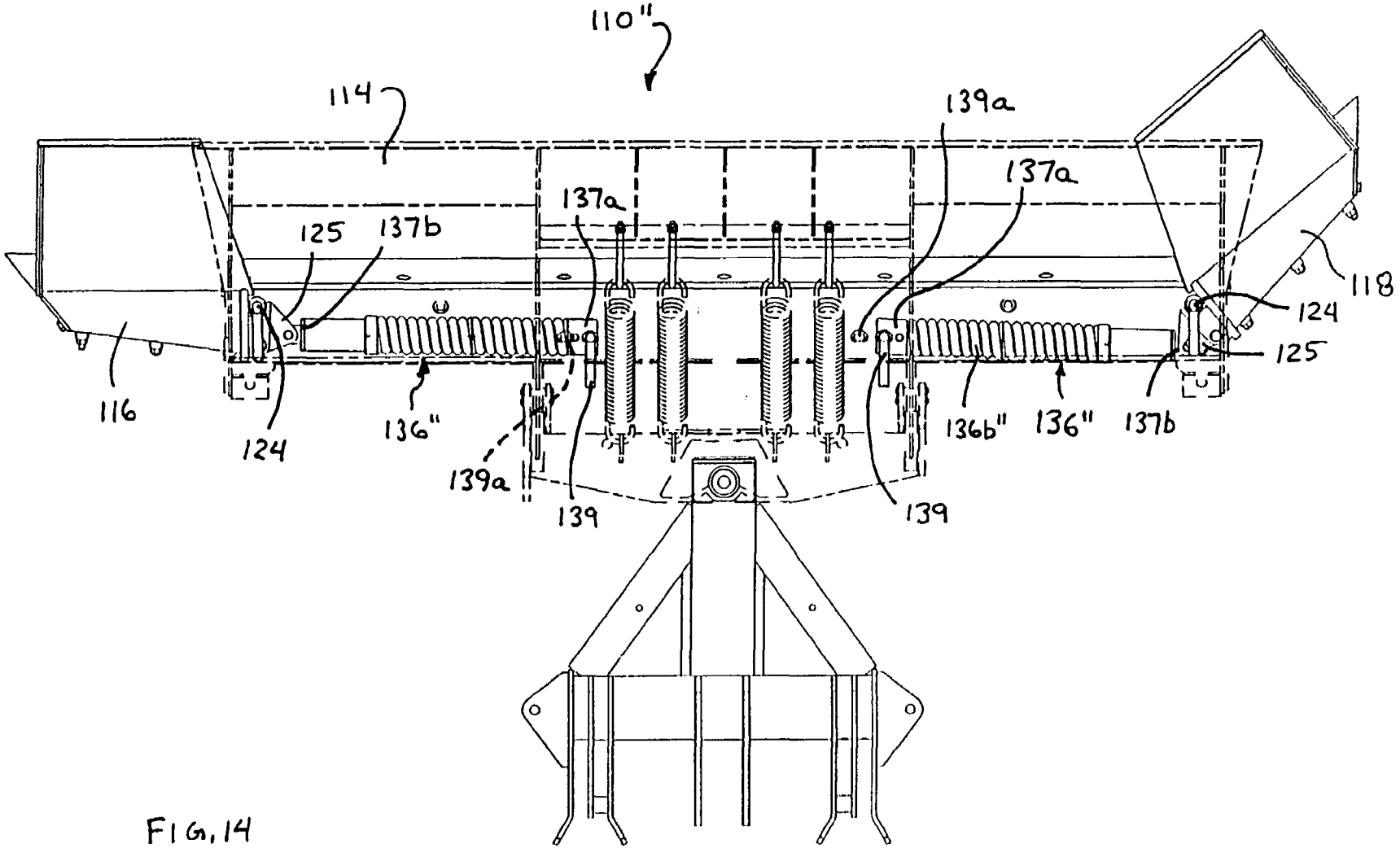
FIG. 14 is a top plan view of another plow assembly in accordance with the present invention, with the plow wings being manually set at their generally aligned position or forwardly angled position.
Figure 15:
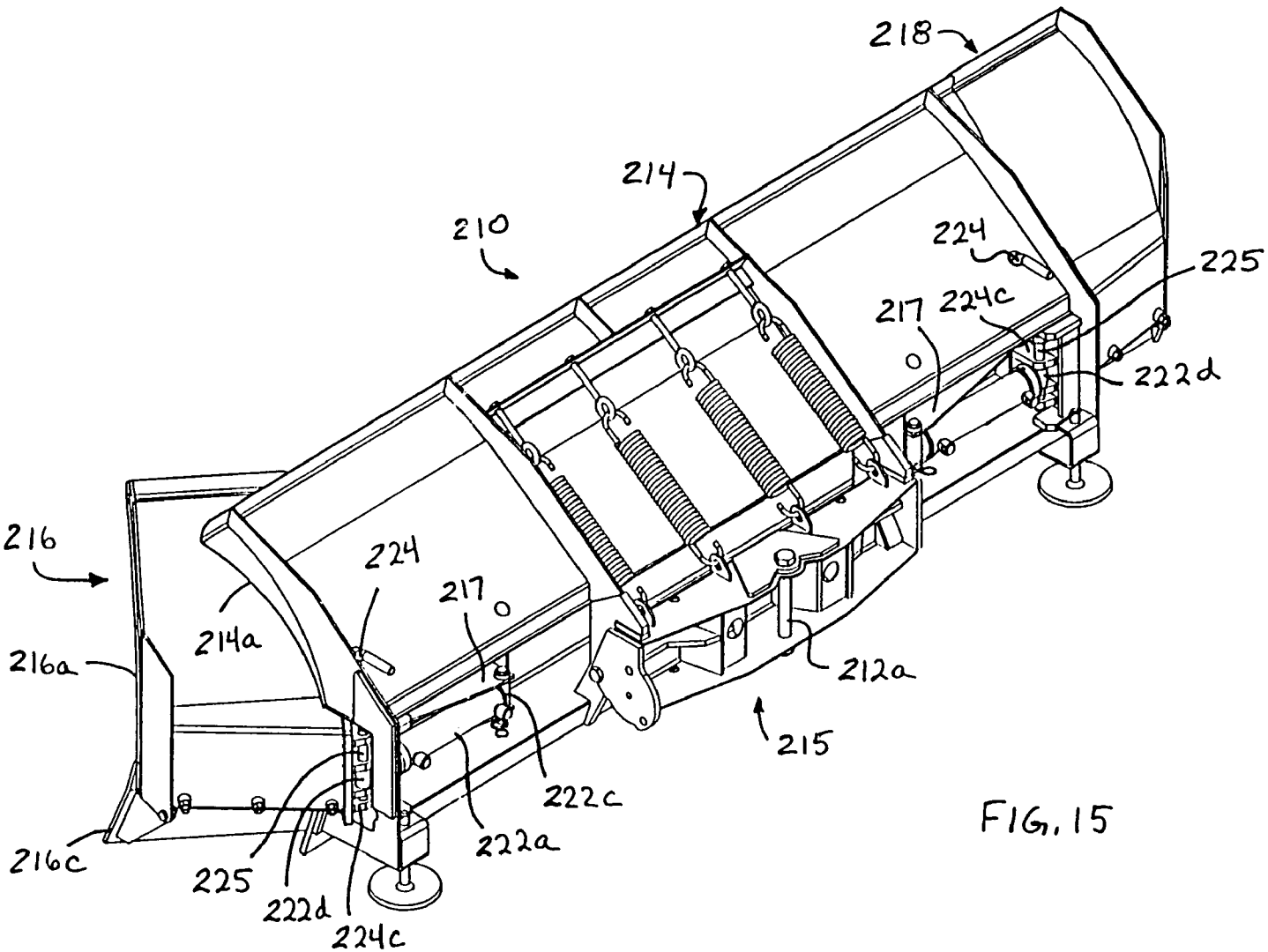
FIG. 15 is a rear perspective view of another plow assembly in accordance with the present invention, with the plow wings being pivotable via respective actuators.

Optionally, and with reference to FIG. 14, a plow assembly 110" may include a biasing/damping device 136" to selectively position the wings 116, 118 in either the aligned or forwardly angled positions relative to the center plow 114. Biasing/damping device 136" may be substantially similar to biasing/damping device 36', discussed above, such that a detailed discussion of the biasing/damping device will not be repeated herein. One end 137*b* of biasing/damping device 136" may be pivotally mounted to the respective plow wing 116, 118, such as at a bracket 125. The other end 137*a* of biasing/damping device 136" may be selectively mounted to center plow 114 via a pin 139. The plow wings 116, 118 may be pivotally attached to the ends of the center plow 114 and may be pivotable about a pivot axis 124. The bracket 125 may extend from or may be attached to the respective plow wing 116, 118 and may be spaced from the pivot axis 124 of the plow wing, such that pivotal movement of bracket 125 causes a corresponding pivotal movement o of plow wing 116, 118 about pivot axis 124.

The end 137*a* of each biasing/damping device 136" may be positioned generally at one of two or more openings 139*a* spaced along the main or center plow 114 (or along a bracket positioned at the rear of the center plow or the like), such that the end 137*a* may be selectively positioned along the center plow 114. The pin 139 may be inserted through the end 137*a* and into the selected opening to mount the end 137*a* of each biasing/damping device 136" at the center plow. As can be seen in FIG. 14, the selected location or hole at which end 137*a* is positioned and mounted determines the angular orientation of the respective plow wing 116, 118. For example, when the end 137*a* of biasing/damping device 136" is mounted to a laterally outward hole at center plow 114, the respective plow wing is pivoted to its forwardly angled position, such as shown with plow wing 118 in FIG. 14. Similarly, when end 137*a* of biasing/damping device 136" is mounted to the laterally inward hole at center plow 114, the respective plow wing is pivoted to its generally aligned position, such as shown with plow wing 116 in FIG. 14.

The plow assembly 110" thus provides a manually adjustable plow assembly where a user of the plow assembly may select which plow wing 116, 118 is to be angled forwardly and which is to be generally aligned, and may attach the end 137*a* of the biasing/damping devices 136" to the center plow in the appropriate manner. The biasing/damping devices 136" thus pivot the plow wings and substantially retain the plow wings in the desired orientation during operation and use of the plow assembly. The spring 136*b*" provides a shock absorbing function for the plow wing if the plow wing encounters or impacts a large object or the like, particularly when the plow wing is in its forwardly angled position. The damping orifice (discussed above with respect to biasing/dampening device 36' of FIG. 11) may also control the decompression of the spring and extension of the biasing/damping device and, thus, may control or dampen or slow the return of the plow wing to the forwardly angled position after impacting the object. The plow assembly of the present invention thus provides for selective positioning of the plow wings and may absorb the shock of the plow wings encountering substantially large and/or immovable objects or bumps or the like.

Although shown as having two spaced apart openings to mount the biasing/damping devices in one of two locations, it is envisioned that more than two openings or one or more slots may be provided to accommodate different mounting locations for different positions of the plow wings, without affecting the scope of the present invention. Also, although shown and described as having two or more mounting locations at or along the center or main plow, it is envisioned that the plow wing or wing bracket may provide two or more different mounting locations such that selective mounting or attaching of the biasing device to the different mounting locations at the plow wing will position the plow wing in the desired or appropriate orientation relative to the center plow, without affecting the scope of the present invention. Also, although shown and described as a biasing/damping device of the type described above with respect to FIG. 11, the plow assembly may include other types of biasing and/or shock absorbing devices or springs or the like, such as the other types of cylinders or spring loaded rods discussed herein, without affecting the scope of the present invention.

Referring now to FIGS. 15–19, a plow assembly 210 includes a pair of plow wings 216, 218 positioned at opposite ends of a center or main plow or mold board 214. Each plow wing 216, 218 is pivotable between a forwardly angled position, such as plow wing 216 is shown in FIGS. 15–19, and a generally aligned orientation, such as plow wing 218 is shown in FIGS. 15–19. Plow wings 216, 218 are pivotable between their forwardly angled positions and generally aligned positions via a wing pivoting system or actuating system 222, which includes a pair of actuators 222*a*, 222*b* operable to pivot the respective plow wings 216, 218. Main or center plow 214 may be mounted to or connected to an intermediate support 215 in a similar manner as center plow 14 is connected to intermediate support 15, discussed above. The intermediate support 215 may be pivotally mountable to a main support or A-frame support or the like (not shown in FIGS. 15–19) and may be pivotable relative to the main support and about a mounting pin 212*a*, which defines a generally vertical pivot axis. The main support may be pivotally mountable to a push beam or the like of a vehicle, such as is known in the art and/or in a similar manner as discussed above with respect to plow assembly 10.

Similar to plow assembly 10, discussed above, center plow 214 of plow assembly 210 may include a main curved mold board or material engaging surface 214*a* and a plow blade 214*b* (FIG. 19) for pushing or plowing snow, dirt, sand, gravel and/or other plowable material as the center plow 214 is moved through the snow or other material by the vehicle. The plow wings 216, 218 also may each include a curved material engaging surface or partial mold board 216*a*, 218*a* (FIG. 19) for pushing the plowed material as plow assembly 210 is moved through the material by the vehicle. The partial mold boards 216*a*, 218*a* may partially overlap the mold board 214*a* of center plow 214, and may have curved inner edges 216*b*, 218*b* (FIG. 19), such that center plow 214 and plow wings 216, 218 maintain a generally uniform and continuous material engaging surface irrespective of the position or orientation of either of the plow wings relative to the center plow. Each of the plow wings 216, 218 may also include a plow blade 216*c*, 218*c* (FIG. 19) along the lower edge of the plow wings.

Figure 17:
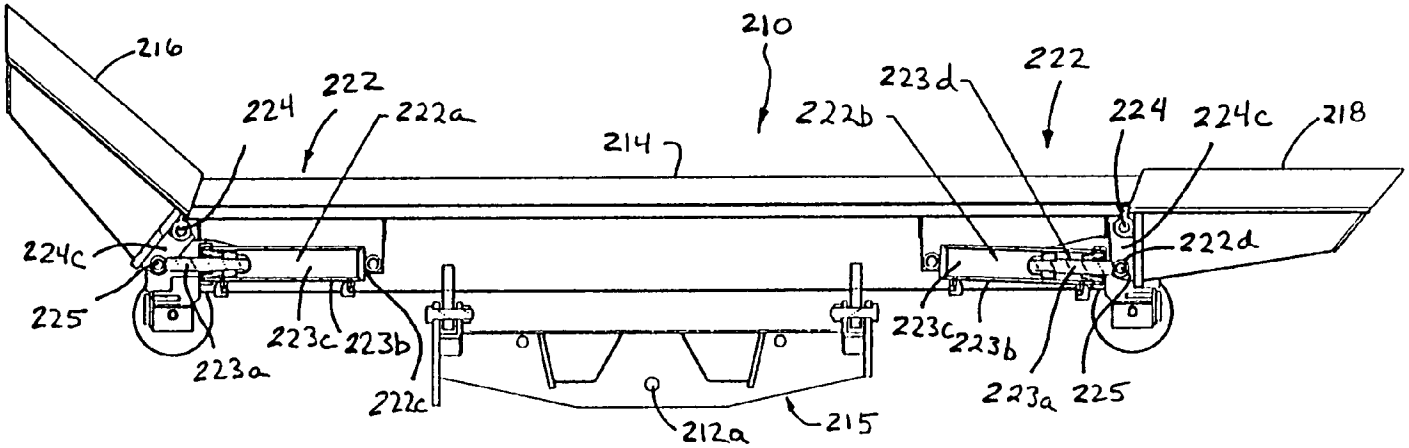
FIG. 17 is a partial sectional view of the plow assembly taken along the line C—C in FIG. 16.
Figure 16:
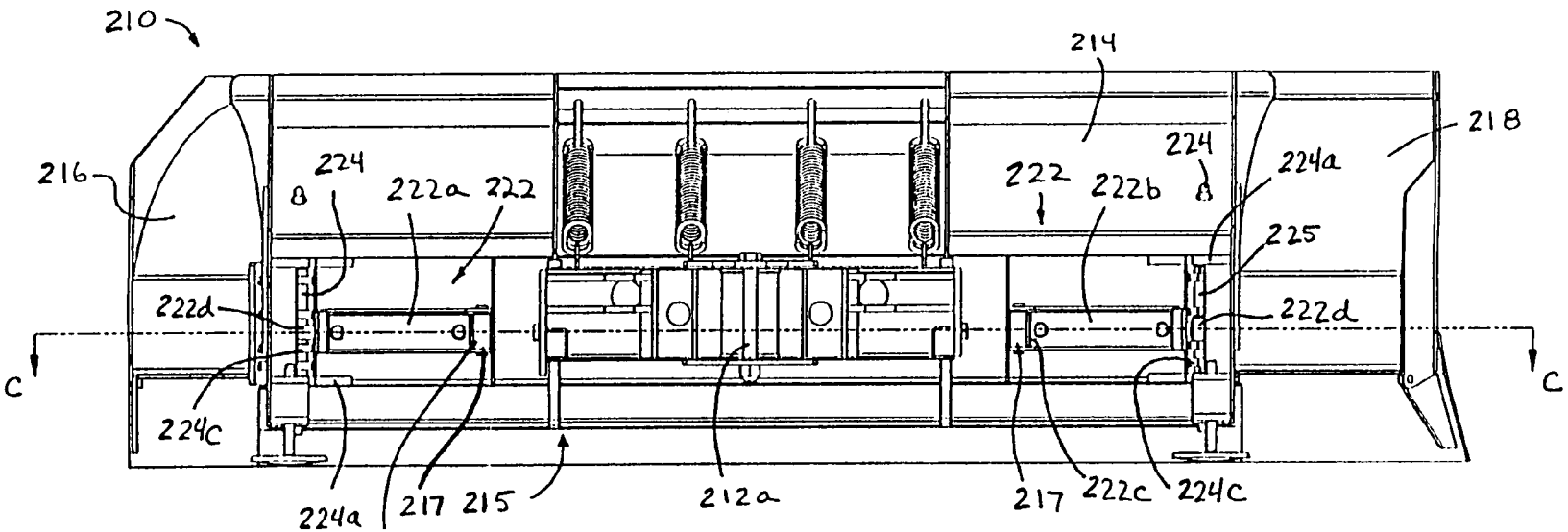
FIG. 16 is a rear elevation of the plow assembly of FIG. 15, with the right plow wing pivoted toward its generally aligned orientation.
Figure 18:
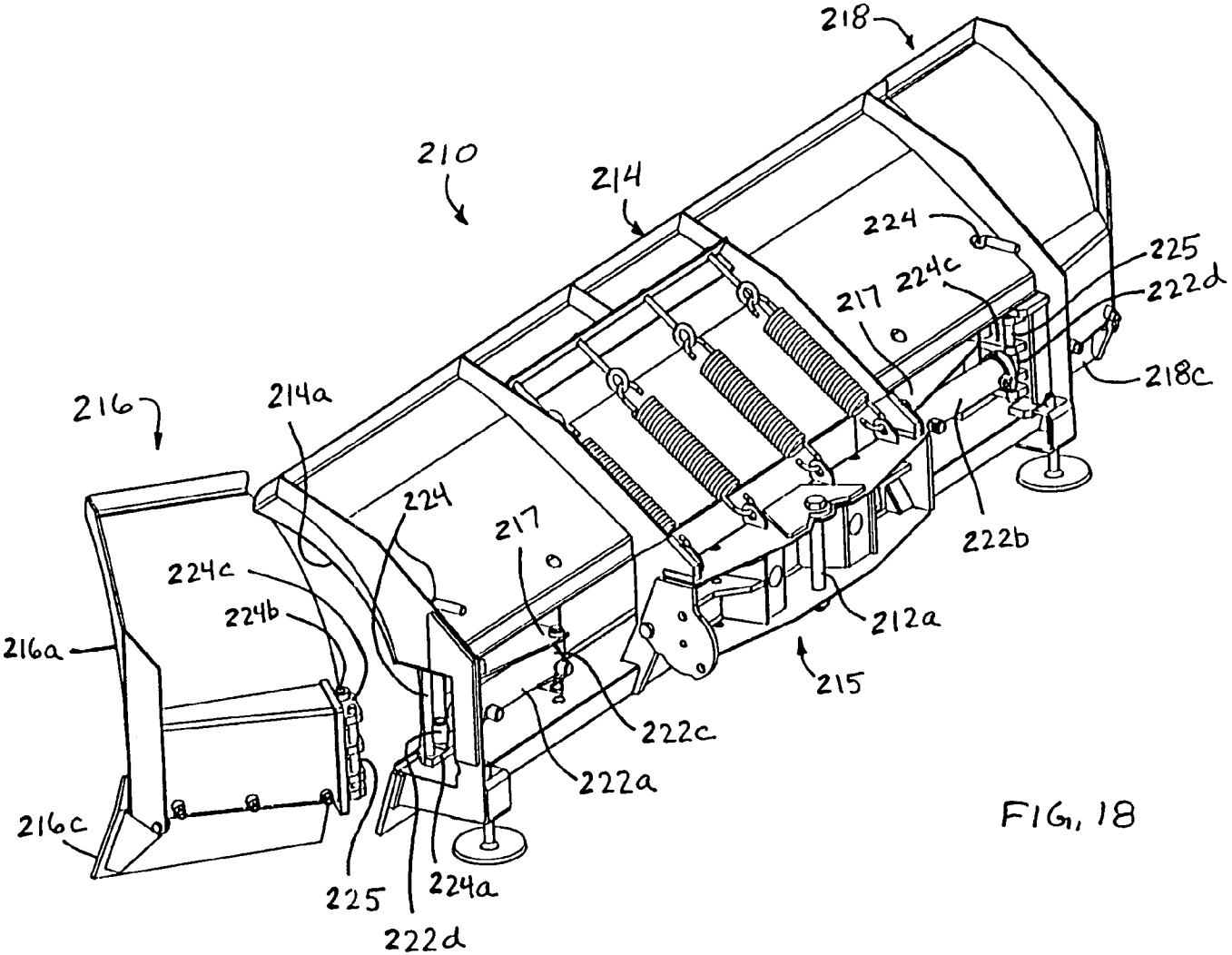
FIG. 18 is an exploded perspective view of the rear of the plow assembly of FIGS. 15–17, with the left plow wing removed from the main plow.

As best shown in FIGS. 16–18, plow wings 216, 218 are pivotally mounted to center plow 214 via a respective hinge or pivot pin 224. As best seen in FIG. 18, pin 224 extends generally vertically through a bracket 224*a* at the respective outer end of center plow 214 and extends through openings 224*b* in a bracket or flange 224*c* at the inner end of the respective plow wing 216, 218. Actuators 222*a*, 222*b* are mounted at one end 222*c* to a bracket 217 at a rear portion of center plow 214 and/or intermediate support 215, and mounted at the other end 222*d* to a respective mounting portion or pin 225 at bracket or flange 224*c* of the respective plow wing 216, 218. Movement of the ends 222*d* of actuators 222*a*, 222*b* relative to center plow 214 thus causes pivotal movement of the respective plow wing 216, 218 about pin 224 to pivot the plow wing between the forwardly angled orientation and the generally aligned orientation with respect to the center or main plow.

In the illustrated embodiment, actuators 222*a*, 222*b* are hydraulic cylinders, which have a rod portion 223*a* which is extendable and retractable relative to a cylinder portion 223*b* in response to pressurized hydraulic fluid being applied at either end of the cylinder portion. The piston rod 223*a* of actuator 222*a*, 222*b* may be extendable and retractable relative to cylinder portion 223*b* to pivot the respective plow wing 216, 218 relative to center plow 214. The piston rod 223*a* is movable within the cylinder portion 223*b* and includes a piston which is slidable within the cylinder portion and divides the cylinder portion to define a laterally inward or head end portion 223*c* of cylinder portion 223*b* and a laterally outward or rod end portion 223*d* of cylinder portion 223*b* at either side of the piston.

In the illustrated embodiment, the head end portion 223*c* of cylinder 223*b* of each actuator 222*a*, 222*b* may be pressurized at a selected pressure, such as via a fluid or gas contained within head end portion 223*c* of cylinder 223*b*. The rod end portion 223*d* of cylinder 223*b* of each actuator 222*a*, 222*b* may be selectively pressurized via a hydraulic system (such as the hydraulic actuating system 200 of FIG. 20, discussed below) to retract piston rods 223*a* into cylinder portions 223*b*, such that plow wings 216, 218 are pivoted toward their aligned positions when the pressure within rod end portion 223*d* is greater than the selected pressure within the head end portion 223*c* of cylinders 223*b*. For example, the head end portion of each cylinder may be pressurized with a fluid or gas, such as, for example, nitrogen or other suitable gas or fluid, at a selected pressure, such as at an initial pressure of approximately 1,000 p.s.i. when the piston rod is extended therefrom, to bias or urge the piston rod toward its extended position, such that the respective plow wing is biased toward its forwardly angled position. Accordingly, in order to retract piston rod 223*a* into cylinder portion 223*b*, hydraulic fluid of sufficient pressure may be applied to the rod end portion 223*d* of cylinder portion 223*b* (such as via respective hydraulic fluid lines 221 in FIG. 20) to overcome the initial pressure within head end portion 223*c* of cylinder portion 223*b*. As the rod end pressure overcomes the head end or biasing pressure, the piston rod may move towards it retracted position, thereby pivoting the plow wing towards its generally aligned position, such as plow wing 218 is shown in FIGS. 15–19.

Figure 20:
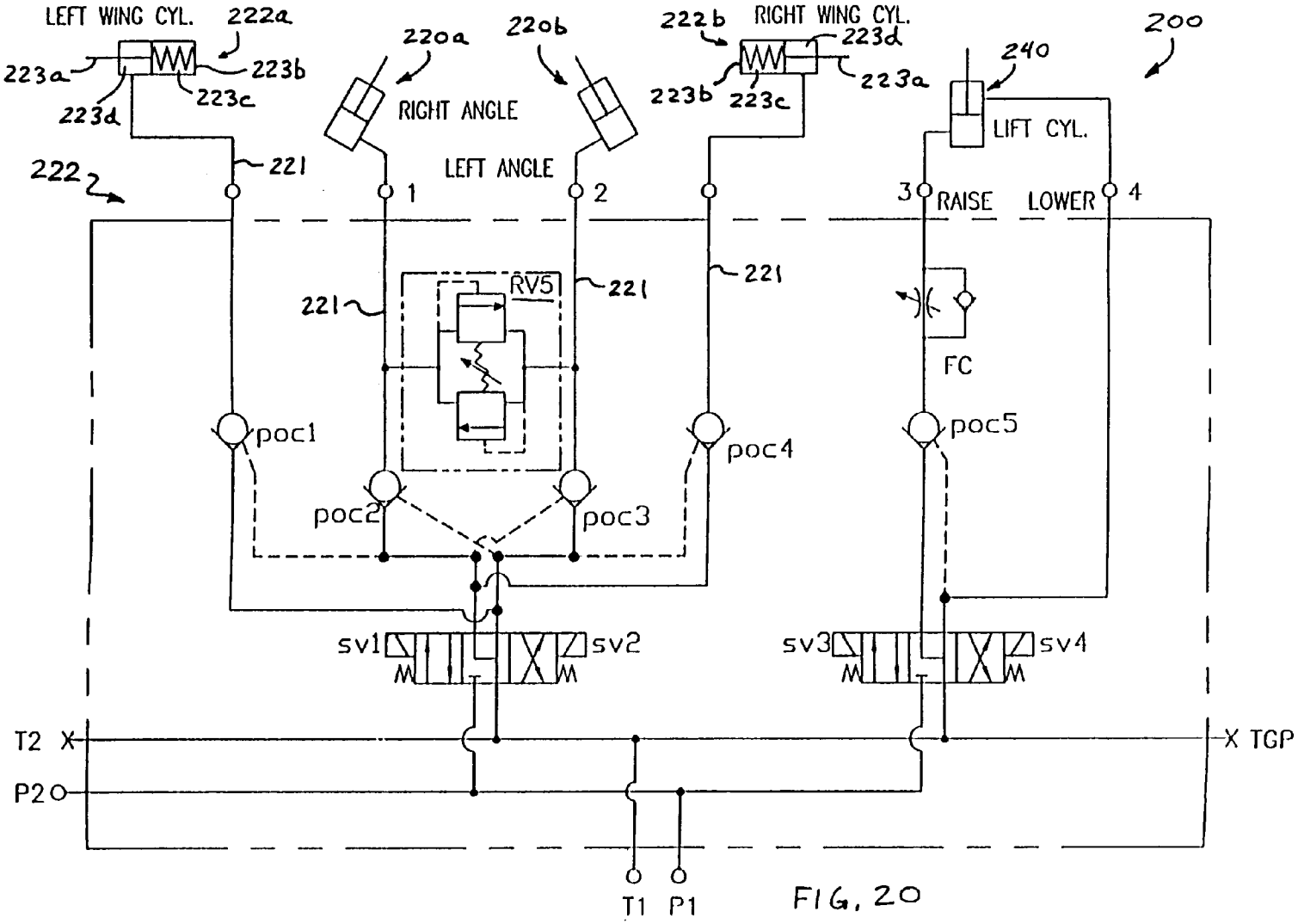
FIG. 20 is a hydraulic schematic of a hydraulic actuating system suitable for use with the plow assembly of the present invention.

Plow wing pivoting system or actuating system 222 may be operable to pivot the plow wings between their forwardly angled positions and their generally aligned positions in response to selectively actuating a switch or valve to pivot the center plow toward one side or the other via a pair of plow angle actuators 220*a*, 220*b* (FIG. 20). The biasing pressure within the head end portion 223*c* of the cylinder 223*b* of each plow wing actuator 222*a*, 222*b* functions to bias the actuator in its extended position, which substantially retains the respective plow wing in its forwardly angled position. The biasing pressure may maintain the respective plow wing in its forwardly angled position until the pressure within the rod end portion of the cylinder overcomes the biasing pressure and thus retracts the piston rod and pivots the plow wing to its generally aligned position. The hydraulic actuating system 200 may function to fully angle or pivot the center plow toward a selected side before the pressure at the rod end portion of the actuator of the trailing plow wing overcomes the biasing pressure within the head end portion of the actuator, as discussed below.

In the illustrated embodiment, and with reference to FIG. 20, rod end portions 223*d* of cylinders 223*b* of actuators 222*a*, 222*b* may be in fluid connection or communication with respective main plow angling actuators 220*a*, 220*b*. Selective actuation of a solenoid valve or switch may apply pressurized hydraulic fluid to fluid lines 221 connected to or in fluid communication with actuators 222*a*, 222*b* and 220*a*, 220*b*. Retraction of piston rod 223*a* of right wing actuator 222*b* may thus be accomplished in response to pivotal movement of center plow 214 toward the right side via actuation or extension of right angle actuator 220*a* at the A-frame support or the like, while retraction of left wing actuator 222*a* may be accomplished in response to pivotal movement of center plow 214 toward the left side via actuation or extension of left angle actuator 220*b*.

Optionally, the biasing pressure in the head end portions 223*d* of cylinder portions 223*b* may be greater than the hydraulic pressure required to extend the respective plow angling actuator 220*a*, 220*b* to pivot the center plow toward the right or left of the vehicle. Accordingly, the plow wings 216, 218 may be biased toward and may remain in their forwardly extended orientation relative to center plow 214 until center plow 214 is at least substantially urged or angled toward one side or the other. As further fluid and/or pressure is applied to the hydraulic lines 221, and as the actuators 220*a*, 220*b* may bottom out or fully extend/retract, the increased pressure in fluid lines 221 may overcome the biasing pressure of the respective trailing wing actuator and may retract the piston rod 223*a* to pivot the respective plow wing toward its generally aligned position. Optionally, the actuating system and plow assembly may be configured such that the pressure applied to the wing actuator of the trailing plow wing increases to the threshold amount to overcome the biasing pressure to retract the wing actuator in response to the main or center plow being urged or angled a predetermined or selected amount between the center position and the fully angled position. The wing actuator may then retract to pivot the trailing plow wing to its aligned position while the center plow may remain at the selected position. Further pressure may then further urge or angle the center plow toward its fully angled position.

As can be seen with reference to FIG. 20, if solenoid valve or switch sv1 of hydraulic actuating system 200 is energized, the right angle or left side actuator or cylinder 220*a* may extend (while the left angle or right side actuate 220*b* may correspondingly retract) to pivot or angle the center plow toward the right side of the vehicle. More particularly, when solenoid valve sv1 is energized, hydraulic fluid may be directed to the right angle actuator or cylinder 220*a* via a pilot operated check valve poc2 to extend actuator 220*a* to angle the center plow toward the right side. Pressurized fluid may also be applied to a pilot operated check valve poc4, but due to the biasing pressure or gas or fluid in the head end portion 223*c* of the right actuator or cylinder 222*b*, the center plow 214 may angle toward the right side via extension of actuator 220*a* (and corresponding retraction of actuator 220*b*), but the right wing actuator 222*b* may generally remain extended and may not retract to pivot the right wing toward its aligned orientation in response to the pressurized fluid in the hydraulic system. However, after center plow 214 is substantially urged or angled toward the right side, actuator 220*a* and/or 220*b* may bottom out and/or fully extend/retract, whereby hydraulic pressure in the lines may buildup at check valves poc2 and poc4 until the pressure within the fluid line is greater than or overcomes the biasing pressure or gas or fluid pressure within the head end portion of the right plow wing actuator 222*b*, whereby the pressurized fluid may flow past the pilot operated check valve poc4 into the rod end portion 222*d* of actuator 222*b* to retract the right wing actuator 222*b* and to pivot the right plow wing 218 to its generally aligned position.

Angling in the other direction may work substantially similar to the manner described above, with the left plow wing remaining in its forwardly angled position until the center plow is substantially fully angled toward the left side, whereby the left plow wing may be pivoted to its generally aligned position. For example, a second switch or solenoid valve sv2 may be actuated to provide pressurized hydraulic fluid to left angle or right side actuator 220*b* and left wing actuator 222*a* via pilot operated check valves poc3 and poc1, respectively. Left wing actuator 222*a* may remain extended until the fluid pressure within the hydraulic lines overcomes the biasing pressure within the head end portion 223*c* of left wing actuator 222*a*.

Optionally, the hydraulic system 200 of FIG. 20 may also allow the operator of the plow assembly to disengage the angle switch or valve sv1, sv2 to stop the angling of the main or center plow 214 toward the respective side just prior to the fully angled position of the center plow, such that the trailing plow wing may remain in its forwardly extended position, whereby the plow assembly may provide a generally U-shaped plow even when angled substantially toward one side or the other, should such a plow configuration be desired. Optionally, pilot pressure from the pressurized hydraulic fluid line may be applied to the pilot operated check valve (poc1, poc4) associated with the actuator of the leading plow wing to open the check valve and allow hydraulic fluid to drain from the outer or rod end portion 223*d* of the actuator 222*a*, 222*b* of the leading plow wing, thereby allowing the actuator to be substantially fully extended via the biasing or pressurized gas or fluid within the actuator to pivot or maintain the leading plow wing in its forwardly angled position.

The present invention thus allows for substantial pivoting of the center plow toward one side or the other, while the plow wings remain in their forwardly angled orientations, and provides automatic pivoting of the trailing plow wing to its generally aligned position in response to the center plow being at least substantially urged or pivoted or angled toward that side. The plow wings thus may both be angled forwardly substantially throughout the full angling range of motion of the center plow, whereby the trailing plow wing may pivot to its aligned orientation in response to the center plow pivoting to its fully angled position or to a selected position between the center position and the fully angled position. This allows the center plow and plow wings to maintain their generally U-shaped orientation throughout the angling range of motion of the center plow, which may be particularly suitable for plowing snow or other material around a curve, because the trailing plow wing will remain angled forwardly to retain the material on the plow as the vehicle and plow assembly are driven around the curve.

As shown in FIG. 20, plow assembly 210 and hydraulic system 200 may include a lift cylinder or actuator 240, which may be operable to raise and lower the center plow relative to the vehicle via pivotal movement of the center plow and support about the generally horizontal axis defined along the rearward end of the support, such as where the support attaches to the push beam or the like of the vehicle. For example, actuation of a solenoid valve sv3 may extend actuator 240 to raise the center plow, while actuation of a solenoid valve sv4 may retract actuator 240 to lower the center plow, such as in a manner known in the art. Also, the hydraulic system 200 may include a cross port relief valve RV5 to allow either of the main plow angle actuators 220*a*, 220*b* to retract in response to excessive load occurring on one of the plow wings.

Therefore, the plow assembly of the present invention may provide a generally U-shaped plow assembly during non-fully angled use or orientation of the center plow, while providing automatic pivoting of the trailing plow wing when the center plow is pivoted at least partially toward the respective side of the vehicle. Although shown and described as having pressurized gas within the wing actuators to bias the actuators toward their extended positions, it is envisioned that other biasing elements or devices or members may be implemented, such as biasing springs or other such elements, without affecting the scope of the present invention.

Figure 21:
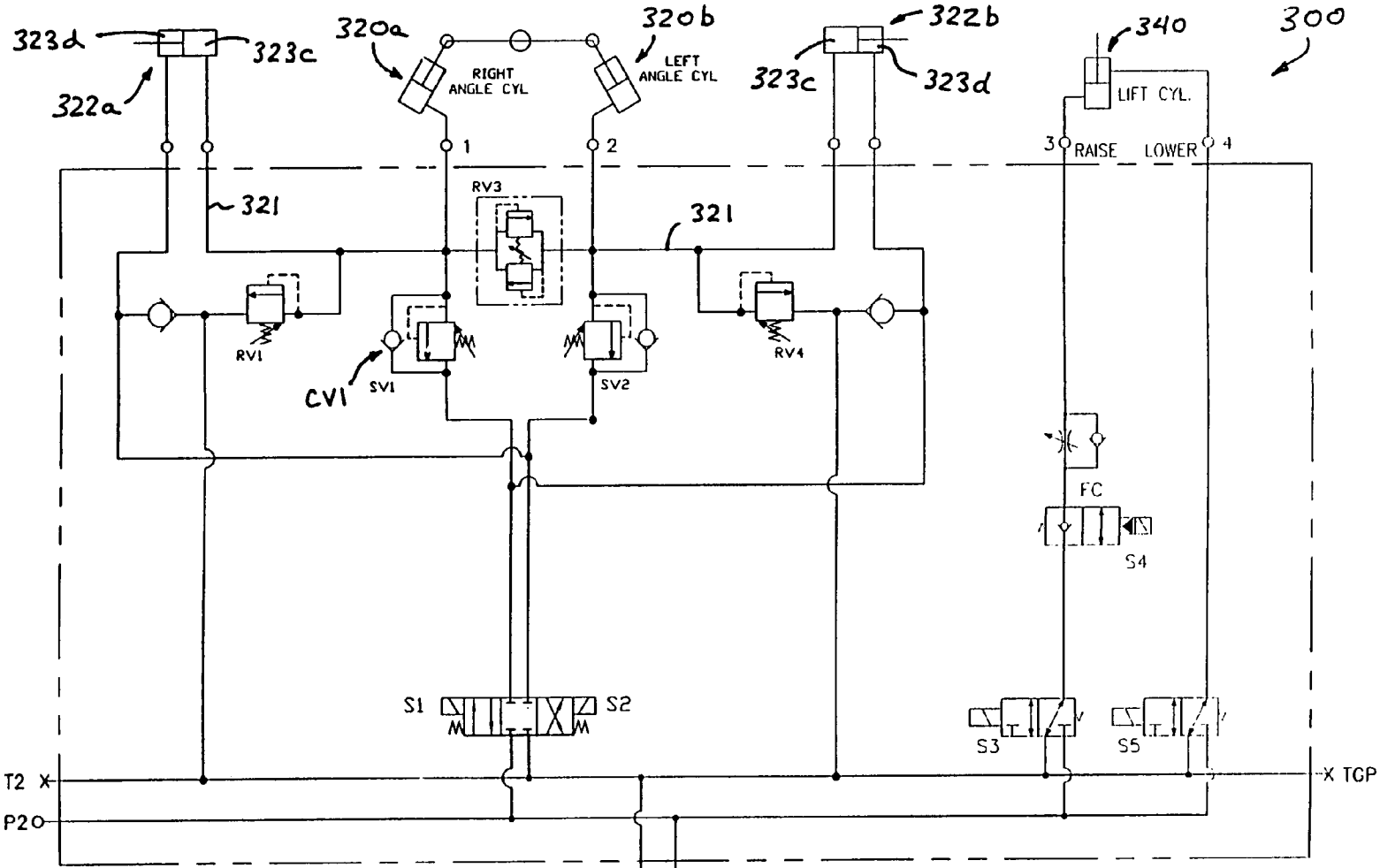
FIG. 21 is a hydraulic schematic of another hydraulic actuating system suitable for use with the plow assembly of the present invention.

Referring now to FIG. 21, a hydraulic schematic of another hydraulic actuating system 300 is shown which may be operable to pivot or angle or urge the center plow toward one side or the other and to pivot or urge the trailing plow wing to its generally aligned position when the center plow is pivoted or urged at least substantially toward its fully angled position or generally to a selected or predetermined position between the center position and its fully angled position. When solenoid valve or switch S1 of hydraulic system 300 is energized, the right angle or left side actuator or cylinder 320*a* may extend (while the left angle or right side actuate 320*b* may correspondingly retract) to pivot or angle the center plow toward the right side of the vehicle. When solenoid S1 is energized, hydraulic fluid may be directed to the right angle actuator or cylinder 320*a* via a check valve CV1 to extend actuator 320*a* to angle the main plow toward the right side. When solenoid valve S1 is actuated, a sequence valve SV2 may allow fluid to pass therethrough, as discussed below. Activation of solenoid valve S1 also provides pressurized fluid to the rod end 323*d* of right wing actuator 322*b* at generally the same pressure as applied to actuator 320*a*. However, the head end portion 323*c* of actuator 322*b* is connected to or in fluid communication with the right side or left angle actuator 320*b* via hydraulic fluid line 321. The pressure (P) in line 321 from retraction of actuator 320*b* (which retracts as actuator 320*a* is extended) is then greater than the pressure (P/1.33 for a cylinder to rod ratio of 1.33 for actuator 322*b*) in the line from head end portion 323*c* of actuator 322*b*. Therefore, actuator 322*b* will not retract as the main plow is pivoted or angled toward the right side.

Sequence valve SV2 includes a pressure valve, such that fluid will not flow through the valve until the pressure in the fluid line overcomes the pressure valve setting or threshold pressure or trigger pressure. For example, the pressure valve may keep the valve closed until the pressure in the line exceeds approximately 500 p.s.i. Therefore, left angle actuator 320*b* may not retract until the pressure in the fluid line 321 reaches that amount. When the pressure reaches that amount, the left angle actuator 320*b* may retract, causing the center plow to pivot toward the right side. The fluid will flow through the sequence valve SV2 and into the tank port of the solenoid valve S1. Although the pressure in fluid line 321 is sufficient to overcome the pressure valve setting of the sequence valve SV1, the pressure in fluid line 321 is also sufficient to limit or substantially preclude retraction of right wing actuator 322*b* while the center plow pivots to the right and, thus, while the left angle actuator 320*b* retracts. When the center plow is substantially fully angled or urged toward the right side, actuator 320*a* and/or 320*b* may bottom out and/or fully extend/retract, such that pressure at line 321 from left angle actuator 320*b* will not increase further. The pressure applied through solenoid valve S1 thus may increase or buildup at rod end portion 323*d* of right wing actuator 322*b* until it is sufficient to overcome the pressure in fluid line 321 and retract the right wing actuator 322*b* to pivot the trailing or right plow wing to its aligned position. Optionally, the hydraulic actuating system may be configured to cause a pressure increase through solenoid valve S1 in response to the plow actuator 320*a*, 320*b* reaching another position before the fully extended/retracted position (and generally corresponding to a selected or particular position of the center plow between the center position and the fully angled position), such that the wing actuator may be retracted in response to the center plow being urged or angled toward the partially angled position between the center position and the fully angled position.

As can be seen in FIG. 21, the left plow wing actuator 322*a* may be pressurized toward its extended state to pivot or maintain the left plow wing in its angled orientation in response to activation of solenoid valve S1. Angling in the other direction may work substantially similar to the manner described above, with the left plow wing remaining in its forwardly angled position until the center plow is substantially fully angled toward the left side, whereby the left plow wing may be pivoted to its generally aligned position. For example, switch or solenoid valve S2 may be actuated to provide pressurized hydraulic fluid to left angle or right side actuator 320*b* and left plow wing actuator 322*a*. Left plow wing actuator 322*a* may remain extended until the fluid pressure at the rod end portion 323*d* of actuator 322*a* overcomes the pressure within hydraulic line 321 as discussed above.

Similar to hydraulic system 200, discussed above, hydraulic system 300 may include a lift cylinder or actuator 340, which may be operable to raise and lower the center plow relative to the vehicle via pivotal movement of the center plow and support about the generally horizontal axis defined along the rearward end of the support, such as where the support attaches to the push beam or the like of the vehicle. For example, actuation of a solenoid valve S3 may extend actuator 340 to raise the center plow, while actuation of a solenoid valve S5 may retract actuator 340 to lower the center plow, such as in a manner known in the art. Also, the hydraulic system 300 may include a cross port relief valve RV3 to allow either of the main plow angle actuators 320*a*, 320*b* to retract in response to excessive load occurring on one of the plow wings. Likewise, hydraulic system may include a relief valve RV1, RV4 at hydraulic lines 321 to provide pressure relief and allow a respective one of the plow wing actuators to retract in response to the respective plow wing encountering an object or the like which results in excessive load or pressure at the head end portion of the plow wing actuator. The pressure valves RV1, RV4 require a greater pressure (such as, for example, 1600 p.s.i.) than the pressure required to open sequence valves SV1, SV2, such that the relief valves RV1, RV4 may only open in response to excessive pressure in the hydraulic fluid lines 321.

Figure 22:
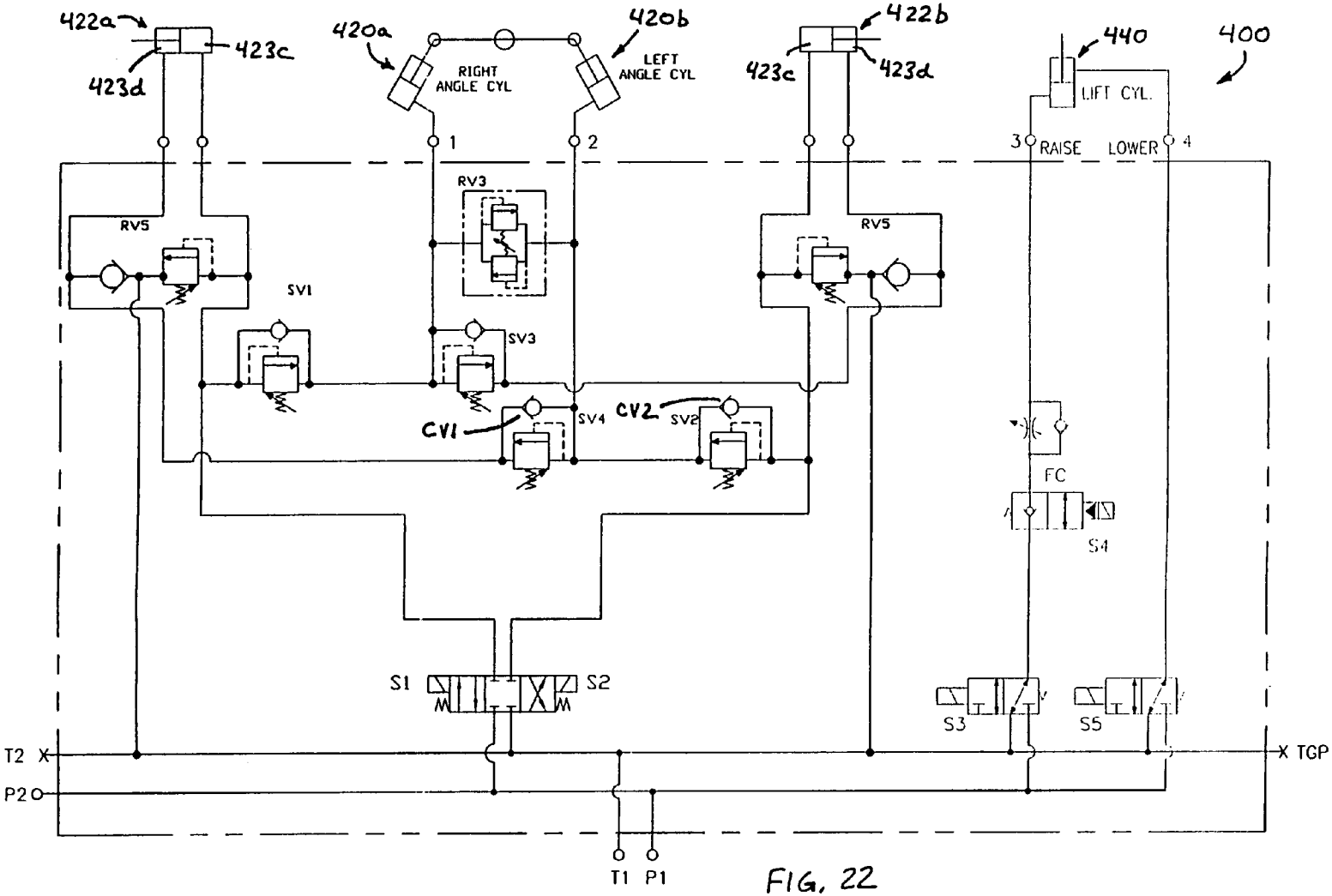
FIG. 22 is a hydraulic schematic of another hydraulic actuating system suitable for use with the plow assembly of the present invention.

Referring now to FIG. 22, a hydraulic schematic of another hydraulic system 400 is shown which also may be operable to pivot or angle the center plow toward one side or the other and to pivot the trailing plow wing to its generally aligned position when the center plow is urged or pivoted at least substantially toward its fully angled position or to a position between the center position and the fully angled position. The plow wings thus may both be angled forwardly substantially throughout the full angling range of motion of the center plow, whereby the trailing plow wing may pivot to its aligned orientation in response to the center plow pivoting to its fully angled position.

With reference to FIG. 22, when solenoid valve or switch S1 of hydraulic system 400 is energized, pressurized fluid is applied to the head end portion 423*c* of left wing actuator 422*a* to extend the actuator and thus pivot the left plow wing to its forwardly angled position. The fluid from the rod end portion 423*d* of left wing actuator 422*a* may flow to the tank port of the solenoid switch or valve S1 via check valves CV1, CV2. After left wing actuator 422*a* is fully extended or bottomed out, pressure will buildup at the inlet port of a sequence valve SV1. Sequence valve SV1 may be activated to allow fluid to flow therethrough when switch S1 is activated. Sequence valve SV1 includes a relief pressure valve, which restricts flow of fluid through the valve until the fluid is at a sufficient pressure, such as, for example, approximately 500 p.s.i. When the pressure in the fluid lines increases to that level, pressurized fluid may be applied to the right angle or left side actuator or cylinder 420*a* to extend right angle actuator 420*a* (while the left angle or right side actuate 420*b* correspondingly retracts) to pivot or angle the center plow toward the right side of the vehicle. As right angle actuator 420*a* extends, left angle actuator 420*b* retracts and fluid from left angle actuator 420*b* may flow to the tank port of the system via check valve CV2.

As pressurized fluid is applied to right angle actuator 420*a*, pressurized fluid is also applied to an inlet port of another sequence valve SV3. The sequence valve SV3 may limit or restrict flow therethrough until the fluid pressure at the inlet port reaches a threshold pressure (such as, for example, approximately 750 p.s.i.) that is greater than the threshold pressure of sequence valve SV1. After the main plow is fully angled toward the right side, and right angle actuator 420*a* is fully extended or bottomed out, the pressure applied to the inlet port of sequence valve SV3 may increase to the threshold pressure of sequence valve SV3 and fluid may flow through the valve and to the rod end portion 422*d* of right wing actuator 422*b*, thereby causing retraction of right wing actuator 422*b* and pivoting of the right plow wing to its aligned orientation (the head end of the right wing actuator may be in fluid communication with the tank port of the solenoid switch or valve S1). Optionally, the plow assembly and/or actuating system may be configured such that the plow actuator 420*a*, 420*b* may require additional pressure to extend further or retract further at a selected degree of extension or retraction or at a selected position of the center plow relative to the vehicle, such that the trailing plow wing may be urged or pivoted toward the aligned position in response to the main or center plow being urged or pivoted toward the selected or partially angled position between the center position and fully angled position.

As can be seen in FIG. 22, the left plow wing actuator 422*a* may be pressurized toward its extended state to pivot or maintain the left plow wing in its angled orientation in response to activation of solenoid valve S1. Angling in the other direction may work substantially similar to the manner described above, with the left plow wing remaining in its forwardly angled position until the center plow is substantially fully angled toward the left side, whereby the left plow wing may be pivoted to its generally aligned position. For example, switch or solenoid valve S2 may be actuated to provide pressurized hydraulic fluid to right wing actuator 422*b* and then to left angle or right side actuator 420*b* when the fluid pressure is sufficient to overcome the pressure valve setting of sequence valve SV2. While left angle actuator 420*b* extends to pivot the center plow toward the left side, left plow wing actuator 422*a* may remain extended until the fluid pressure at the inlet port of sequence valve SV4 overcomes the threshold pressure setting of sequence valve SV4, as discussed above.

Similar to hydraulic systems 200, 300, discussed above, hydraulic system 400 may include a lift cylinder or actuator 440, which may be operable to raise and lower the center plow relative to the vehicle via pivotal movement of the center plow and support about the generally horizontal axis defined along the rearward end of the support, such as where the support attaches to the push beam or the like of the vehicle. For example, actuation of a solenoid valve S3 may extend actuator 440 to raise the center plow, while actuation of a solenoid valve S5 may retract actuator 440 to lower the center plow, such as in a manner known in the art. Also, the hydraulic system 400 may include a cross port relief valve RV3 to allow either of the center plow angle actuators 420*a*, 420*b* to retract in response to excessive load occurring on one of the plow wings. Likewise, hydraulic system 400 may include a relief valve RV5 to provide pressure relief and allow a respective one of the plow wing actuators to retract in response to the respective plow wing encountering an object or the like which results in excessive load or pressure at the head end portion of the plow wing actuator.

Figure 23:
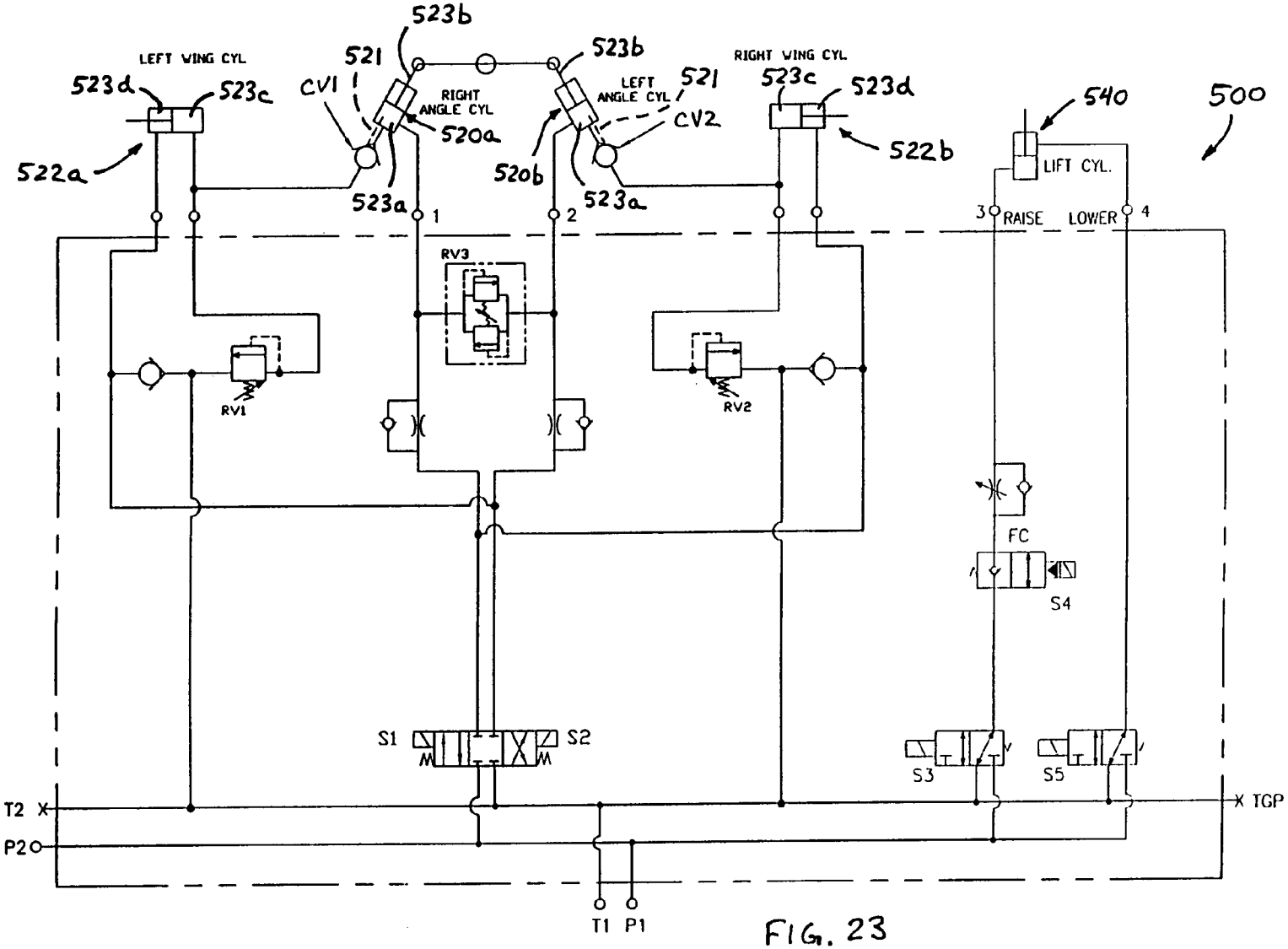
FIG. 23 is a hydraulic schematic of another hydraulic actuating system suitable for use with the plow assembly of the present invention.

Referring now to FIG. 23, a hydraulic schematic of another hydraulic actuating system 500 is shown which also may be operable to pivot or angle the center plow toward one side or the other and to pivot the trailing plow wing to its generally aligned position when the center plow is urged or pivoted at least substantially toward its fully angled position or to a partially angled position between the center position and the fully angled position. More particularly, when solenoid valve or switch S1 of hydraulic system 500 is energized, pressurized fluid is applied to the rod end portion 523*d* of right wing actuator 522*b* to apply pressure to retract the actuator and thus urge or pivot the right plow wing to its aligned position. However, pressure in the head end portion 523*c* of right wing actuator 522*b* at least initially limits or substantially precludes retraction of the actuator, as discussed below.

When the switch S1 is actuated, pressurized fluid is also applied to the port of the left side or right angle plow actuator 520*a* to pivot the center plow toward the right side. Pressurized fluid may also be applied to the head end portion 523*c* of left wing actuator 522*a* via a check valve CV1 between plow actuator 520*a* and left wing actuator 522*a*, in order to extend and maintain extension of the leading or left wing actuator 522*a* to urge the left plow wing toward its forwardly angled position.

As pressurized fluid is applied to right angle plow actuator 520*a*, the actuator extends to pivot the center plow, which causes a corresponding retraction of the right side or left angle plow actuator 520*b*. The retraction causes fluid to be forced from the left angle plow actuator 520*b* to a tank port of the hydraulic system. When the left angle plow actuator 520*b* has retracted a predetermined amount, such as at or substantially near bottoming out of the actuator, a check valve release mechanism or device 521 may open the check valve CV2 between left angle plow actuator 520*b* and right wing actuator 522*b*. When the check valve CV2 opens, fluid may flow from right wing actuator 522*b* through the check valve CV2 to the tank port, thereby allowing the pressurized fluid at the rod end portion 523*d* of right wing actuator 522*b* to retract right wing actuator 522*b* to pivot the right plow wing toward its aligned position.

Angling in the other direction may work substantially similar to the manner described above, with the left plow wing remaining in its forwardly angled position until the center plow is at least substantially angled toward the left side, whereby the left plow wing may be pivoted to its generally aligned position. For example, switch or solenoid valve S2 may be actuated to provide pressurized hydraulic fluid to left wing actuator 522*b* and to left angle or right side actuator 520*b* in a similar manner as discussed above.

Figure 24:
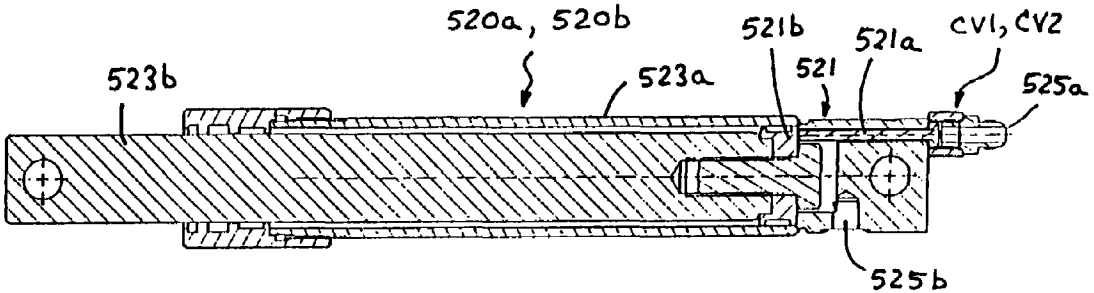
FIG. 24 is a sectional view of a plow actuator useful with the hydraulic actuating system of FIG. 23.

Optionally, and with reference to FIG. 24, the plow actuators 520*a*, 520*b* may include the respective check valves CV1, CV2 and check valve release mechanisms 521. In the illustrated embodiment of FIG. 24, the check valve CV1, CV2 is at a fluid port 525*a* at the head end portion of a cylinder 523*a* of the actuator 520*a*, 520*b*. Check valve CV1, CV2 may allow fluid to flow from the plow actuator, but will limit or substantially preclude fluid flow into the plow actuator when the check valve is closed. Check valve release mechanism 521 may comprise a rod or valve member 521*a* which may be movable between a closed position, where a valve end at least substantially closes the fluid port 525*a*, and an opened position, where the valve end is unseated and allows fluid to flow through the fluid port 525*a* and into the plow actuator 520*a*, 520*b*. As can be seen in FIG. 24, the rod portion 523*b* of actuator 520*a*, 520*b* may include a contact member 521*b* for engaging valve member 521*a* and moving valve member 521*a* to the opened position as rod portion 523*b* is moved substantially to its bottoming out position relative to cylinder 523*a* of actuator 520*a*, 520*b*. When check valve CV1, CV2 is opened, fluid may flow from the head end portion 522*c* of the respective wing actuator 522*a*, 522*b* through check valve CV1, CV2 into plow actuator 520*a*, 520*b* and out through the fluid port 525*b*, which connects the actuator 520*a*, 520*b* to the pressure or tank ports of the actuating system via solenoid valves or switches S1, S2. The length and/or location of the valve member and check valve may be selected, or the check valve or actuating system may otherwise be configured, to provide release of the check valve at a desired amount of retraction of the actuator 520*a*, 520*b*, which corresponds to a desired amount or degree of angling of the center plow between the center position and the fully angled position.

Hydraulic actuating system 500 may also include a relief valve or port RV1, RV2 which functions to allow fluid to flow from the head end portion 522*c* of the respective wing actuator 522*a*, 522*b* when the check valve CV1, CV2 is not opened. For example, in situations where an excessive load impacts the right plow wing, the pressure in the head end portion of the right wing actuator will increase as the plow wing is pushed toward its aligned position. When the pressure reaches a threshold level, such as, for example, approximately 1500 p.s.i., the relief valve RV1, RV2 may open to allow the fluid to flow from the head end portion of the wing actuator to the tank port of the actuating system, thereby allowing the plow wing to be pivoted toward its aligned position. Likewise, hydraulic system 500 may include a relief valve RV3 to provide pressure relief and allow one of the plow actuators to retract in response to the plow encountering an object or the like which results in excessive load or force at one side of the plow. Similar to hydraulic systems 200, 300, 400, discussed above, hydraulic system 500 may also include a lift cylinder or actuator 540, which may be operable to raise and lower the center plow relative to the vehicle via pivotal movement of the center plow and support about the generally horizontal axis defined along the rearward end of the support, such as where the support attaches to the push beam or the like of the vehicle. Similar to hydraulic system 200, discussed above, hydraulic systems 300, 400, 500 may also allow the operator of the plow assembly to disengage the angle switches S1, S2 to stop the angling of the center plow toward the respective side just prior to the fully angled position of the center plow or prior to the selected or partially angled position between the center position and fully angled position of the center plow, such that the trailing plow wing may remain in its forwardly extended position, whereby the plow assembly may provide a generally U-shaped plow even when angled at least partially toward one side or the other, should such a plow configuration be desired.

The present invention thus allows for substantial urging or pivoting of the main or center plow toward one side or the other, while the plow wings may remain in their forwardly angled orientations, and provides automatic pivoting of the trailing plow wing to its generally aligned position in response to the center plow being at least substantially or fully pivoted or angled toward that side. The plow wings thus may both be angled forwardly substantially throughout the full or desired angling range of motion of the center plow, whereby the trailing plow wing may pivot to its aligned orientation in response to the center plow pivoting at least substantially to its fully angled position or to the partially angled position between the center position and the fully angled position. This allows the center plow and plow wings to maintain their generally U-shaped configuration throughout a desired angling range of motion of the center plow, which may be particularly suitable for plowing snow or other material around a curve, because the trailing plow wing will remain angled forwardly to retain the material on the plow as the vehicle and plow assembly are driven around the curve. Although specific examples of hydraulic actuating systems are shown and described herein, it is envisioned that other types or configurations of actuating systems may be implemented to achieve the desired function, without affecting the scope of the present invention.

Figure 25:
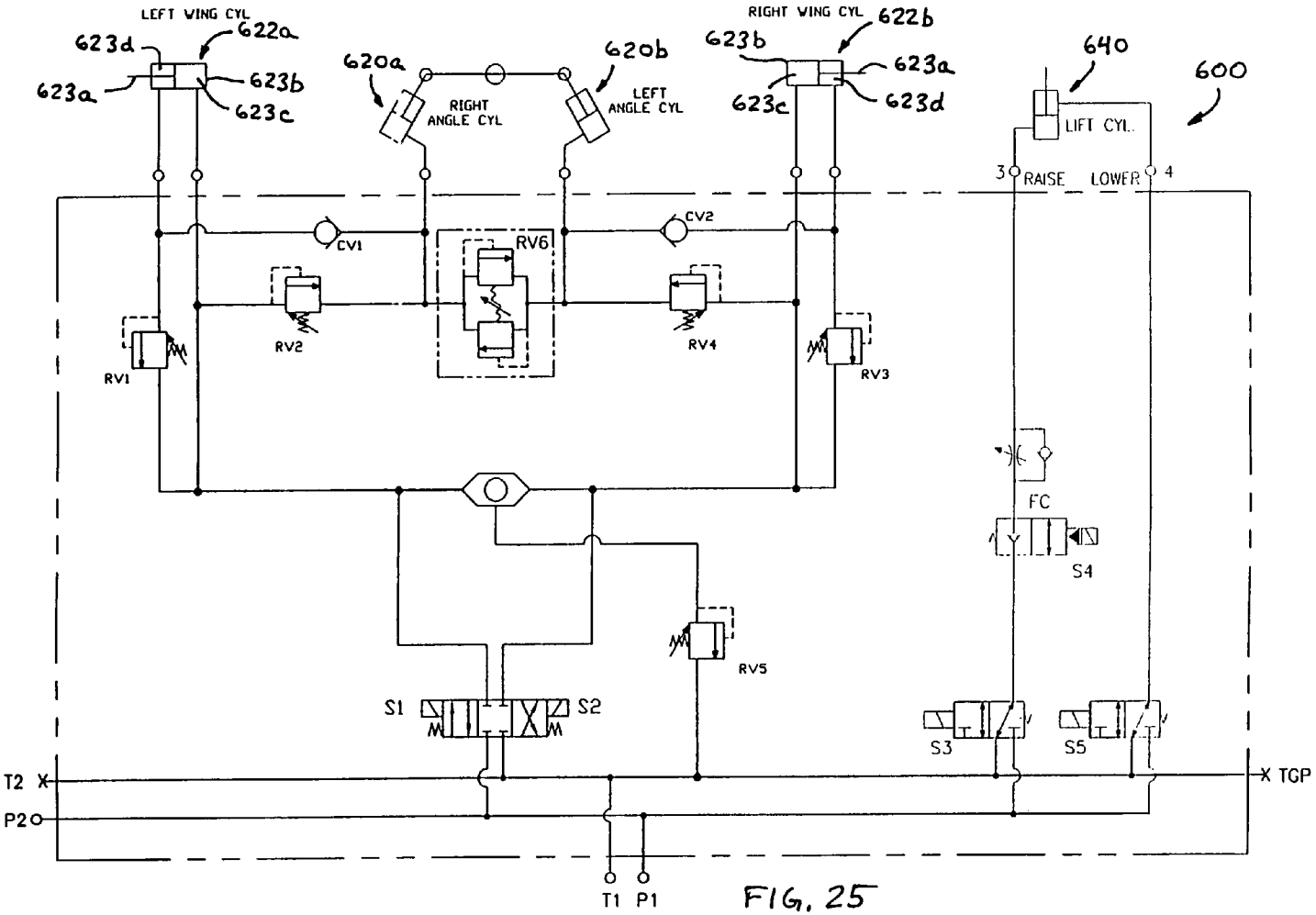
FIG. 25 is a hydraulic schematic of another hydraulic actuating system suitable for use with the plow assembly of the present invention.

Referring now to FIG. 25, a hydraulic schematic of another hydraulic actuating system 600 is shown. Hydraulic actuating system 600 may be operable to automatically pivot the trailing plow wing toward and into its aligned orientation as the main or center plow is angled or pivoted toward that side. The actuating system may be configured such that the trailing plow wing may pivot to and reach its fully aligned position before the center plow pivots or angles toward that side. For example, the left plow wing may pivot toward and to its aligned position, and then the center plow may angle all the way toward the left side in response to a switch or valve being actuated to pivot the center plow toward the left side. Optionally, the hydraulic system may be operable to fully pivot the leading plow wing to its fully angled position before pivoting the trailing plow wing to its aligned position, and thus before angling the center plow toward the trailing plow wing side, as discussed below.

More particularly, and with reference to FIG. 25, an operator may, for example, activate the hydraulic system to pivot the center plow toward the right side by actuating solenoid control valve S1. When solenoid valve S1 is activated, pressurized hydraulic fluid may be provided to an inner or head end portion 623*c* of a hydraulic cylinder 623*b* of left wing cylinder or actuator 622*a* and to an outlet of a relief valve RV1. Because of the cylinder or piston ratio of actuator 622*a*, the pressure in the rod end or outer end portion 623*d* of cylinder 623*b* is greater than the pressure in the head end portion 623*c* of cylinder 623*b*. For example, the pressure at the rod end portion 623*d* may be approximately 1.33 times the pressure at the head end portion 623*c* (for a piston rod and piston assembly having a piston area that is approximately 1.33 times the area of the piston less the rod diameter). Therefore, the fluid pressure at the inlet of relief valve RV1 is a greater pressure than the pressure at the outlet of relief valve RV1. However, the relief valve RV1 will not open until the pressure applied at the inlet of relief valve RV1 is greater than the sum of the pressure at the outlet end of the relief valve plus the relief valve pressure required to open the relief valve when there is no pressure at the outlet end. For example, with a relief valve pressure or resistance of approximately 350 p.s.i., the pressure in the hydraulic line from solenoid S1 at which the relief valve RV1 will open is approximately 1060 p.s.i. (p+350=1.33 p). Accordingly, when the main line pressure reaches approximately 1060 p.s.i., the relief valve RV1 may open and the left wing cylinder 622*a* may extend to move the left wing to the fully angled position relative to the center plow.

After the left wing actuator or cylinder 622*a* is fully angled forwardly, the fluid pressure may increase in the hydraulic lines until the pressure is high enough to overcome the resistance or threshold pressure in a relief valve RV2 (such as, for example, approximately 1250 p.s.i.). When the pressure increases a sufficient amount, relief valve RV2 may open and the pressurized fluid may be applied to the left side plow cylinder or the right angle plow cylinder or actuator 620*a*. Because of the mechanical linkage between the plow cylinders 620*a*, 620*b*, as the left plow cylinder 620*a* extends to angle the center plow to the right side, the right plow cylinder (or left angle cylinder) 620*b* retracts, whereby fluid may exit the right plow cylinder 620*b* and may pass through a check valve CV2 and into a rod end or outer end portion 623*d* of the cylinder portion 623*b* of right wing cylinder or actuator 622*b*. Because the head end portion 623*c* of cylinder 623*b* of right wing actuator 622*b* may be connected to a tank port of the directional solenoid control valve S1, S2, piston rod 623*a* of right wing cylinder 622*b* may retract to pivot the right plow wing toward and into its aligned orientation relative to the center plow.

After the right plow wing is fully pivoted to its aligned orientation and/or actuator 622*b* bottoms out, the pressurized fluid exiting from the right plow cylinder 620*b* may overcome the resistance or threshold pressure of a relief valve RV3, which may have a resistance of approximately 350 p.s.i., and may pass through relief valve RV3 to allow the center plow to continue to angle toward the right side. Therefore, the center plow may not angle toward one side or the other until after the trailing plow wing is at least substantially urged or pivoted to its aligned orientation. The operation of hydraulic system 600 is substantially identical for pivoting the left plow wing to its aligned position and pivoting the center plow toward the left side in response to actuation of solenoid valve S2.

Additionally, hydraulic system 600 may provide a relief operation to allow the plow wing or center plow to pivot in response to one of the plow wings striking an immovable object. More particularly, an external load at one of the plow wings may produce an increased pressure in the respective plow wing actuator and in the corresponding plow cylinder. For example, an external load at the end of the right plow wing may produce a pressure in the right side (or left angle) plow cylinder 620*b* that is approximately 2.12 times the load force at the right plow wing, while producing a pressure in the right wing actuator head end or inner end portion of approximately 1.68 times the load force at the right plow wing, due to the geometry of the plow and plow wings. Because the right plow cylinder 620*b* is in fluid communication with the rod end portion of the right plow wing actuator 622*b*, the pressure in the right plow cylinder 620*b* is additive to the right plow wing head end pressure. Therefore, the pressure in the right wing cylinder head end portion may be approximately 3.27 times the force exerted at the end of the right plow wing (1.68 F+(2.12 F/1.33)), based on the geometry of the plow assembly and on the cylinder ratio of the right plow wing actuator.

The pressure resistance at relief valve RV4 may be selected to avoid allowing fluid to overcome the relief valve RV4 during such a condition. Therefore, the pressure resistance at relief valve RV4 may be selected to be approximately 1250 p.s.i., such that the pressure balance at relief valve RV4 occurs at a force at the plow wing of approximately 1083 pounds (2.12 F (the pressure at the discharge end of the relief valve)+1250=3.27 F). However, the relief valve RV5 may discharge to a tank and may have a pressure resistance of approximately 2500 p.s.i., such that the relief valve RV5 may open when the force at the plow wing is approximately 764 pounds or more (3.27 F=2500). Therefore, the right wing actuator or cylinder may retract under a load of approximately 764 pounds at the end of the right plow wing. After the right plow wing actuator bottoms out in its fully retracted orientation, the left angle cylinder 620*b* may pass pressurized fluid through a relief valve RV6 to allow the center plow to pivot toward the right side. For example, relief valve RV6 may provide a pressure resistance or opening pressure of approximately 3500 p.s.i., such that left angle cylinder 520*b* may retract when the force at the right plow wing reaches approximately 1650 pounds (2.12 F=3500).

The hydraulic system may function in a substantially identical manner if the left plow wing strikes or engages a substantially immovable object. The hydraulic system of the present invention thus may allow each plow wing to pivot toward its aligned position and may further allow the center plow to pivot toward that side in response to the plow wing striking or engaging an object with a sufficient force. It is noted that the values set forth above are exemplary values only, and other ratios of forces and/or pressures may occur, depending on the geometry of the plow assembly, main or center plow, plow wings and/or cylinders or actuators and/or the like, without affecting the scope of the present invention.

As can be seen in FIG. 25, the plow assembly may include a lift cylinder or actuator 640, which may be operable to raise and lower the center plow relative to the vehicle via pivotal movement of the center plow and support about the generally horizontal axis defined along the rearward end of the support, such as where the support attaches to the push beam or the like of the vehicle. For example, actuation of a solenoid valve S3 may extend actuator 640 to raise the center plow, while actuation of a solenoid valve S5 may retract actuator 640 to lower the center plow, such as in a manner known in the art.

The hydraulic system of the present invention thus may pivot the trailing plow wing to its aligned position before angling the main or center plow toward that side. The hydraulic system may also provide pressurized hydraulic fluid to the other or leading plow wing while the center plow is pivoting toward the trailing plow wing side. This may provide pressurized fluid to the leading plow wing actuator, so that if the leading plow wing strikes an object and is pushed back toward its generally aligned position, the pressurized fluid may extend the leading wing actuator to push the leading plow wing back to its forwardly angled position as the center plow continues to pivot toward its angled position on the other side. Pressurized fluid may also be provided to the actuators of both plow wings to bias or urge the plow wings toward their forwardly angled position when the center plow is generally at its straight or non-angled orientation relative to the support. Although a specific example of an actuating system is shown and described herein, it is envisioned that other types or configurations of actuating systems may be implemented to achieve the desired function, without affecting the scope of the present invention.

Therefore, the present invention provides a plow assembly which includes a pair of plow wings which are biased or urged or initially angled toward a forwardly angled position to define a generally U-shaped plow when the main or center plow is positioned in its generally straight or non-angled position. The material engaging surfaces of the plow wings and center plow may be curved, and the material engaging surfaces or moldboards of the plow wings may partially overlap the material engaging surface or mold board of the center plow to provide a generally uniform and continuous surface. The plow wings may have curved inner edges, such that the center plow and the plow wings maintain a generally uniform and continuous material engaging surface irrespective of the position or orientation of either of the plow wings relative to the center plow. The plow wings may be pivotally mounted at the ends of the center plow via respective hinges that may be positioned generally rearward of the material engaging surfaces of the plow wings and the center plow so as to provide a substantially continuous plow surface throughout the range of pivotal adjustment of the plow wing or wings relative to the main or center plow.

The plow assembly of the present invention provides for pivotal movement of a trailing plow wing as the center plow is angled toward that side of the vehicle. The plow wing may be maintained in its forwardly angled position at least partially or substantially throughout the range of angling motion of the center plow, and then may be pivoted to its generally aligned position in response to the center plow reaching the fully or partially angled position or a trigger position or angle that is toward that side. The plow wings may be biased toward their forwardly angled positions to substantially preclude angling of the plow wings toward their aligned positions until the center plow is fully angled toward one side or the other of the vehicle or until the center plow is partially angled a desired amount toward one side or the other. Optionally, the plow assembly of the present invention may be operable to pivot the plow wings to their generally aligned position prior to angling the center plow toward either side. The plow wings may be pivoted or moved between their forwardly angled position and generally aligned position via a hydraulic actuating system or via a mechanical actuating system, such as via cables and lever arms and the like, or via any other actuating means or systems or biasing devices or elements or the like. The trailing plow wing may be pivoted toward its aligned position in response to the center plow being pivoted to and beyond a particular position or angle or trigger position/angle or the plow wing may pivot toward its aligned position in response to a trigger pressure in the fluid lines that overcomes a pressure valve setting.

Changes and modifications in the specifically described embodiments may be carried out without departing from the principles of the present invention, which is intended to be limited only by the scope of the appended claims, as interpreted according to the principles of patent law.

The invention claimed is:

1. A plow assembly for a vehicle, said plow assembly comprising:

a center plow having first and second ends;

a support for attaching said center plow to the vehicle, said center plow being pivotable relative to the vehicle between a first position, where said center plow is pivoted toward said first end, and a second position, where said center plow is pivoted toward said second end;

a first plow wing on said first end of said center plow and a second plow wing on said second end of said center plow, each of said first and second plow wings being pivotable between an angled position, where said plow wing is angled forwardly with respect to said center plow, and an aligned position, where said plow wing is generally aligned with said center plow, said first and second plow wings being biased toward said angled positions via at least one biasing member; and a wing pivoting system for pivoting said first and second plow wings relative to said center plow, said wing pivoting system being operable to pivot said first plow wing to said aligned position in response to said center plow being pivoted to said first position and to pivot said second plow wing to said aligned position in response to said center plow being pivoted to said second position, said wing pivoting system comprising at least one connected member connected between said first and second plow wings and said support, said at least one connecting member being configured to move said first plow wing toward said aligned position as said center plow is pivoted toward said first position and to allow said first plow wing to move toward said angled position in response to said at least one biasing member as said center plow is pivoted away from said first position, said at least one connecting member being configured to move said second plow wing toward said aligned position as said center plow is pivoted toward said second position and to allow said second plow wing to move toward said angled position in response to said at least one biasing member as said center plow is pivoted away from said second position.

2. The plow assembly of claim 1, wherein said at least one connecting member comprises at least one cable connected between said first and second plow wings and said support.

3. The plow assembly of claim 2, wherein said at least one cable connects to a first lever arm connected to said first plow wing, said at least one cable moving said first lever arm relative to said center plow to pivot said first plow wing to said aligned position in response to pivotal movement of said center plow toward said first end.

4. The plow assembly of claim 3, wherein said at least one cable is movable outwardly toward said second end in response to pivotal movement of said center plow toward said first end to allow a second lever arm at said second plow wing to move to allow said second plow wing to pivot toward said angled position in response to said at least one biasing member.

5. The plow assembly of claim 2, wherein said at least one cable comprises first and second cables, said first cable being connected between said support and said first plow wing and said second cable being connected between said support and said second plow wing.

6. The plow assembly of claim 1, wherein said at least one biasing member comprises a spring loaded member extending between and connecting to said first and second plow wings.

7. The plow assembly of claim 1, wherein said at least one biasing member comprises first and second biasing members, said first biasing member urging said first plow wing toward said angled position and said second biasing member urging said second plow wing toward said angled position.

8. The plow assembly of claim 7, wherein each of said first and second biasing members comprises a spring that is compressed when the respective plow wing is pivoted toward said aligned position.

9. The plow assembly of claim 8, wherein each of said first and second biasing members comprises a dampening device to restrict decompression of said spring to dampen movement of said respective plow wing to said angled position.

10. The plow assembly of claim 7, wherein each of said first and second biasing members is selectively mountable at said main plow in one of at least two positions, said biasing members biasing said plow wings toward different positions depending on which of said at least two positions is selected.

11. The plow assembly of claim 1, wherein said at least one connecting member connects to an extension of said support, said extension extending forwardly from a pivot axis of said center plow, such that said extension causes said at least one connecting member to pull at one of said plow wings in response to said center plow pivoting toward a respective one of said first and second positions.

12. The plow assembly of claim 11, wherein said at least one connecting member connects to a lever arm at each of said first and second plow wings and pivots said lever arm relative to said center plow to pivot at least one of said first and second plow wings.

13. The plow assembly of claim 1, wherein said first plow wing has a curved material engaging surface which substantially corresponds to a curved material engaging surface of said center plow.

14. The plow assembly of claim 13, wherein said first plow wing is pivotally mounted on said first end of said center plow via a hinge member that is positioned generally rearward of said curved material engaging surfaces of said first plow wing and said center plow.

15. The plow assembly of claim 1, wherein said first plow wing is at least partially positioned in front of a material engaging surface of said center plow, said first plow wing having a curved inner edge which generally corresponds to a curve of said material engaging surface of said center plow such that said curved inner edge at least partially engages said curved material engaging surface of said center plow to provide a substantially continuous material engaging surface when said first plow wing is in said angled position.

16. A plow assembly for a vehicle, said plow assembly comprising:

a center plow having first and second ends;

a support for attaching said center plow to the vehicle, said center plow being pivotable relative to the vehicle between a first position, where said center plow is pivoted toward said first end, and a second position, where said center plow is pivoted toward said second end;

a first plow wing on said first end of said center plow and a second plow wing on said second end of said center plow, each of said first and second plow wings being pivotable between an angled position where said plow wing is angled forwardly with respect to said center plow, and an aligned position, where said plow wing is generally aligned with said center plow; and a first biasing member connected between said center plow and said first plow wing and a second biasing member connected between said center plow and said second plow wing, each of said biasing members being selectively mounted at one of said center plow and said plow wing at one of at least two mounting positions, said biasing members being selectively mounted at a first mounting position or a second mounting position, said biasing member positioning the respective plow wing in said aligned position when at said first mounting position and said biasing member positioning the respective plow wing in said angled position when at said second mounting position, said biasing members being compressible to at least partially absorb an impact of said respective plow wing with an object during operation of said plow assembly.

17. The plow assembly of claim 16, wherein each of said first and second biasing members comprises a spring that is compressed when the respective plow wing impacts an object.

18. The plow assembly of claim 17, wherein each of said first and second biasing members comprises a dampening device to restrict decompression of said spring.

19. The plow assembly of claim 16, wherein each of said first and second biasing members are selectively mountable to said center plow via a respective pin being inserted through an opening at an end of said biasing member and through an opening at said center plow.

20. The plow assembly of claim 19, wherein said pin is selectively insertable through one of at least two openings at said center plow to selectively mount said biasing member at said center plow.

21. The plow assembly of claim 19, wherein said pin is selectively insertable through one of at least two openings at said center plow to selectively mount said biasing member at said center plow.

22. The plow assembly of claim 21, wherein said first plow wing is substantially fixed in said angled position when said center plow is generally in said center position.

23. The plow assembly of claim 22, wherein said first plow wing is released and is pivotable in response to said center plow angling toward said first position.

24. The plow assembly of claim 21, wherein said first plow wing is biased toward said angled position via a pressurized cylinder, said pressurized cylinder containing compressible gas which is compressed as said first plow wing is pivoted toward said aligned position.

25. The plow assembly of claim 16, wherein said first plow wing has a curved material engaging surface which substantially corresponds to a curved material engaging surface of said center plow.

26. The plow assembly of claim 25, wherein said first plow wing is pivotally mounted on said first end of said center plow via a hinge member that is positioned generally rearward of said curved material engaging surfaces of said first plow wing and said center plow.

27. The plow assembly of claim 16, wherein said first plow wing is at least partially positioned in front of a material engaging surface of said center plow, said first plow wing having a curved inner edge which generally corresponds to a curve of said material engaging surface of said center plow such that said curved inner edge at least partially engages said curved material engaging surface of said center plow to provide a substantially continuous material engaging surface when said first plow wing is in said angled position.

28. A plow assembly for a vehicle, said plow assembly comprising:

a center plow having first and second ends, said center plow being mountable to the vehicle and being pivotable relative to the vehicle between a first position, where said center plow is pivoted toward said first end, and a center position, where said center plow is positioned generally normal to the direction of travel of the vehicle;

a first plow wing pivotally mounted at said first end of said center slow, said first plow wing being pivotable between an angled position, where said first plow wing is angled forwardly with respect to said center plow, and an aligned position, where said first plow wing is generally aligned with said center plow; and an actuating system operable to urge said first plow wing toward said angled position until said center plow is urged at least substantially toward one of said first position and a position between said first and center positions, said actuating system urging said first plow wing toward said aligned position in response to said center plow being urged at least substantially toward said one of said first position and a position between said first and center positions;

wherein said actuating system includes a first wing actuator operable to urge said first plow wing toward said aligned position;

wherein said actuating system includes at least one plow actuator operable to pivot said center plow between said first and center positions;

wherein said actuators are responsive to pressurized fluid; and wherein said actuating system includes a valve that limits fluid flow to or from said first wing actuator until said center plow is at least substantially urged toward said one of said first position and a position between said first and center positions.

29. The plow assembly of claim 28, wherein said at least one plow actuator includes a valve opening device operable to open said valve to allow fluid to flow to or from said first wing actuator when said plow actuator is moved to a threshold position generally corresponding to said center plow being at least substantially urged toward said one of said first position and a position between said first and center positions.

30. A plow assembly for a vehicle, said plow assembly comprising;

a center plow having first and second ends, said center plow being mountable to the vehicle and being pivotable relative to the vehicle between a first position, where said center plow is pivoted toward said first end, and a center position, where said center plow is positioned generally normal to the direction of travel of the vehicle;

a first plow wing pivotally mounted at said first end of said center plow, said first plow wing being pivotable between an angled position, where said first plow wing is angled forwardly with respect to said center plow, and an aligned position, where said first plow wing is generally aligned with said center plow; and an actuating system operable to urge said first plow wing toward said angled position until said center plow is urged at least substantially toward one of said first position and a position between said first and center positions, said actuating system urging said first plow wing toward said aligned position in response to said center plow being urged at least substantially toward said one of said first position and a position between said first and center positions;

wherein said actuating system includes a first wing actuator operable to urge said first plow wing toward said aligned position;

wherein said actuating system includes at least one plow actuator operable to pivot said center plow between said first and center positions;

wherein said actuators are responsive to pressurized fluid; and wherein said first wing actuator is operable to urge said first plow wing toward said aligned position in response to a threshold hydraulic pressure applied thereto, said plow assembly being configured such that the hydraulic pressure applied to said first wing actuator reaches said threshold hydraulic pressure when said center plow is at least substantially urged toward said one of said first position and a position between said first and center positions.

31. A plow assembly for a vehicle, said plow assembly comprising:

a center plow having first and second ends, said center plow being mountable to the vehicle and being pivotable relative to the vehicle between a first position, where said center plow is pivoted toward said first end, and a center position, where said center plow is positioned generally normal to the direction of travel of the vehicle;

a first plow wing pivotally mounted at said first end of said center plow, said first plow wing being pivotable between an angled position, where said first plow wing is angled forwardly with respect to said center plow, and an aligned position, where said first plow wing is generally aligned with said center plow; and an actuating system operable to urge said first plow wing toward said angled position until said center plow is urged at least substantially toward one of said first position and a position between said first and center positions, said actuating system urging said first plow wing toward said aligned position in response to said center plow being urged at least substantially toward said one of said first position and a position between said first and center positions;

wherein said actuating system includes a first wing actuator operable to urge said first plow wing toward said aligned position;

wherein said actuating system includes at least one glow actuator operable to pivot said center plow between said first and center positions;

wherein said actuators are responsive to pressurized fluid; and wherein said actuating system is operable to apply an aligning pressure to said first wing actuator to urge said first plow wing toward said aligned position, said aligning pressure being greater than a plow pressure applied to said at least one plow actuator to pivot said center plow between said first and center positions.

32. The plow assembly of claim 31, wherein said aligning pressure is applied to said first wing actuator after said center plow is substantially urged toward said one of said first position and a position between said first and center positions.

33. A plow assembly for a vehicle, said plow assembly comprising:

a center plow having first and second ends, said center plow being mountable to the vehicle and being pivotable relative to the vehicle between a first position, where said center plow is pivoted toward said first end, and a center position, where said center plow is positioned generally normal to the direction of travel of the vehicle;

a first plow wing pivotally mounted at said first end of said center plow, said first plow wing being pivotable between an angled position, where said first plow wing is angled forwardly with respect to said center plow, and an aligned position, where said first plow wing is generally aligned with said center plow; and an actuating system operable to urge said first plow wing toward said angled position until said center plow is urged at least substantially toward one of said first position and a position between said first and center positions, said actuating system urging said first slow wing toward said aligned position in response to said center plow being urged at least substantially toward said one of said first position and a position between said first and center positions;

wherein said actuating system includes a first wing actuator operable to urge said first plow wing toward said aligned position;

wherein said actuating system includes at least one plow actuator operable to pivot said center plow between said first and center positions;

wherein said actuators are responsive to pressurized fluid;

wherein said actuating system is operable to apply an aligning pressure to said first wing actuator to urge said first plow wing toward said aligned position, said aligning pressure being greater than a plow pressure applied to said at least one plow actuator to pivot said center plow between said first and center positions; and wherein said aligning pressure is applied to said first wing actuator after said center plow is substantially urged toward said one of said first position and a position between said first and center positions.

34. The plow assembly of claim 33, wherein said actuating system includes at least one valve which restricts flow of fluid therethrough until the fluid pressure at said valve increases to a threshold level, said first wing actuator urging said first plow wing toward said aligned position in response to said at least one valve allowing fluid to flow therethrough.

35. The plow assembly of claim 34, wherein said at least one valve restricts flow of fluid from said first wing actuator until the fluid pressure at said valve increases to said threshold level.

36. The plow assembly of claim 34, wherein said at least one valve restricts flow of fluid from said first wing actuator until the fluid pressure at said valve increases to said threshold level.

37. The plow assembly of claim 34, wherein said plow assembly is configured such that said at least one valve allows fluid to flow therethrough when said center plow is urged at least substantially toward said one of said first position and a position between said first and center positions.

38. A plow assembly for a vehicle, said plow assembly comprising:

a center plow having first and second ends, said center plow being mountable to the vehicle and being pivotable relative to the vehicle between a first position, where said center plow is pivoted toward said first end, and a center position, where said center plow is positioned generally normal to the direction of travel of the vehicle;

a first plow wing pivotally mounted at said first end of said center plow, said first plow wing being pivotable between an angled position, where said first plow wing is angled forwardly with respect to said center plow, and an aligned position, where said first plow wing is generally aligned with said center plow; and an actuating system operable to urge said first plow wing toward said angled position until said center plow is urged at least substantially toward one of said first position and a position between said first and center positions said actuating system urging said first plow wing toward said aligned position in response to said center plow being urged at least substantially toward said one of said first position and a position between said first and center positions;

wherein said first plow wing is biased via a biasing device which exerts a biasing force at said first plow wing to bias said first plow wing toward said angled position to maintain said first plow wing in said angled position until said center plow is substantially urged toward said one of said first position and a position between said first and center positions.

39. The plow assembly of claim 38, wherein said plow assembly is configured such that said actuating system overcomes said biasing device to pivot said first plow wing to said aligned position in response to said center plow being urged at least substantially toward said one of said first position and a position between said first and center positions.

40. The plow assembly of claim 39, wherein said biasing device comprises at least one of a pressurized cylinder and a spring element.

41. A plow assembly for a vehicle, said plow assembly comprising:

a center plow having first and second ends, said center plow being mountable to the vehicle and being pivotable relative to the vehicle between a first position, where said center plow is pivoted toward said first end, and a center position, where said center plow is positioned generally normal to the direction of travel of the vehicle;

a first plow wing pivotally mounted at said first end of said center plow, said first plow wing being pivotable between an angled position, where said first plow wing is angled forwardly with respect to said center plow, and an aligned position, where said first plow wing is generally aligned with said center plow; and an actuating system operable to urge said first plow wing toward said angled position until said center plow is urged at least substantially toward one of said first position and a position between said first and center positions, said actuating system urging said first plow wing toward said aligned position in response to said center plow being urged at least substantially toward said one of said first position and a position between said first and center positions;

including a second plow wing pivotally mounted to said second end of said center plow, said center plow being pivotable toward a second position where said center plow is pivoted toward said second end, said second plow wing being pivotable between said angled position and said aligned position in response to said center plow being at least substantially urged toward one of said second position and a position between said second and center positions.

42. The plow assembly of claim 41, wherein said actuating system is operable to urge said second plow wing toward said angled position before said first plow wing is urged toward said aligned position when said center plow is at least substantially urged toward one of said first position and a position between said first and center positions.

43. A plow assembly for a vehicle, said plow assembly comprising:

a center plow having first and second ends, said center plow being mountable to the vehicle and being pivotable relative to the vehicle between a first position, where said center plow is pivoted toward said first end, and a center position, where said center plow is positioned generally normal to the direction of travel of the vehicle;

a first plow wing pivotally mounted at said first end of said center plow, said first plow wing being pivotable between an angled position, where said first plow wing is angled forwardly with respect to said center plow, and an aligned position, where said first plow wing is generally aligned with said center plow; and an actuating system operable to urge said first plow wing toward said angled position until said center plow is urged at least substantially toward one of said first position and a position between said first and center positions, said actuating system urging said first plow wing toward said aligned position in response to said center plow being urged at least substantially toward said one of said first position and a position between said first and center positions;

wherein said first plow wing has a curved material engaging surface which substantially corresponds to a curved material engaging surface of said center plow.

44. The plow assembly of claim 43, wherein said first plow wing is pivotally mounted on said first end of said center plow via a hinge member that is positioned generally rearward of said curved material engaging surfaces of said first plow wing and said center plow.

45. A plow assembly for a vehicle, said plow assembly comprising:

a center plow having first and second ends, said center plow being mountable to the vehicle and being pivotable relative to the vehicle between a first position, where said center plow is pivoted toward said first end, and a center position, where said center plow is positioned generally normal to the direction of travel of the vehicle;

a first plow wing pivotally mounted at said first end of said center plow, said first plow wing being pivotable between an angled position, where said first plow wing is angled forwardly with respect to said center plow, and an aligned position, where said first plow wing is generally aligned with said center plow; and an actuating system operable to urge said first plow wing toward said angled position until said center plow is urged at least substantially toward one of said first position and a position between said first and center positions, said actuating system urging said first plow wing toward said aligned position in response to said center plow being urged at least substantially toward said one of said first position and a position between said first and center positions;

wherein said first plow wing is at least partially positioned in front of a material engaging surface of said center plow, said first plow wing having a curved inner edge which generally corresponds to a curve of said material engaging surface of said center plow such tat said curved inner edge at least partially engages said curved material engaging surface of said center plow to provide a substantially continuous material engaging surface when said first plow wing is in said angled position.

46. A plow assembly for a vehicle, said plow assembly comprising:

a center plow having first and second ends;

a support for attaching said center plow to the vehicle, said center plow being pivotable relative to the vehicle between a first position, where said center plow is pivoted toward said first end, and a center position, where said center plow is positioned generally normal to the direction of travel of the vehicle;

a first plow wing pivotally mounted to said first end of said center plow, said first plow wing being pivotable between an angled position, where said first plow wing is angled forwardly with respect to said center plow, and an aligned position, where said first plow wing is generally aligned with said center plow; and an actuating system comprising at least one plow actuator operable to pivot said center plow between said first and center positions, and a first wing actuator operable to pivot said first plow wing between said angled and aligned positions, said actuators being responsive to fluid pressure generated by said actuating system, said first wing actuator being operable to urge said first plow wing toward said aligned position in response to a first pressure being applied to said first wing actuator, said at least one plow actuator being operable to urge said center plow toward said first position in response to a second pressure being applied to said at least one plow actuator, said first pressure being less than said second pressure such that said first plow wing is at least substantially urged toward said aligned position before said center plow is urged toward said first position.

47. The plow assembly of claim 46 including a second plow wing pivotally mounted to said second end of said center plow, said second plow wing being pivotable between said angled and aligned positions, said actuating system comprising a second wing actuator operable to pivot said second plow wing between said angled and aligned positions, said second wing actuator being operable to urge said second plow wing toward said aligned position in response to said fist pressure being applied to said second wing actuator, said second plow wing being at least substantially urged toward said aligned position before said center plow is urged toward a second position, where said center plow is pivoted toward said second end.

48. The plow assembly of claim 47, wherein said actuating system is operable to urge said second plow wing toward said angled position before said first plow wing is urged toward said aligned position and before said center plow is urged toward said first position.

49. The plow assembly of claim 46, wherein said first plow wing has a curved material engaging surface which substantially corresponds to a curved material engaging surface of said center plow.

50. The plow assembly of claim 49, wherein said first plow wing is pivotally mounted on said first end of said center plow via a hinge member that is positioned generally rearward of said curved material engaging surfaces of said first plow wing and said center plow.

51. The plow assembly of claim 46, wherein said first plow wing is at least partially positioned in front of a material engaging surface of said center plow, said first plow wing having a curved inner edge which generally corresponds to a curve of said material engaging surface of said center plow such that said curved inner edge at least partially engages said curved material engaging surface of said center plow to provide a substantially continuous material engaging surface when said first plow wing is in said angled position.

52. A plow assembly for a vehicle, said plow assembly comprising:

a center plow having first and second ends;

a support for attaching said center plow to the vehicle, said center plow being pivotable relative to the vehicle between a first position, where said center plow is pivoted toward said first end, and a second position, where said center plow is pivoted toward said second end;

a first plow wing on said first end of said center plow and a second plow wing on said second end of said center plow, each of said first and second plow wings being pivotable between an angled position, where said plow wing is angled forwardly with respect to said center plow, and an aligned position, where said plow wing is generally aligned with said center plow; and a first biasing member connected between said center plow and said first plow wing and a second biasing member connected between said center plow and said second plow wing, said biasing member urging the respective plow wing toward said angled position, said biasing members limiting pivoting of the respective plow wings toward said aligned positions until sufficient force is exerted on the respective plow wings.

53. The plow assembly of claim 52, wherein each of said first and second biasing members comprises a spring that is compressed when sufficient force is exerted on the respective plow wing.

54. The plow assembly of claim 53, wherein each of said first and second biasing members comprises a dampening device to restrict decompression of said spring.

55. The plow assembly of claim 52, wherein each of said first and second biasing members comprises a pressurized cylinder, said pressurized cylinder containing compressible gas that is compressed when sufficient force is exerted on the respective plow wing.

56. The plow assembly of claim 52, wherein said first plow wing is pivotable toward said aligned position in response to a sufficient force against said first plow wing in a direction generally along said center plow at least when said center plow is angled toward said first position.

57. The plow assembly of claim 56, wherein said second plow wing is pivotable toward said aligned position in response to a sufficient force against said second plow wing in a direction generally along said center plow at least when said center plow is angled toward said second position.

58. The plow assembly of claim 52, wherein each of said first and second plow wings has a curved material engaging surface which substantially corresponds to a curved material engaging surface of said center plow.

59. The plow assembly of claim 58, wherein said first plow wing is at least partially positioned in front of a material engaging surface of said center plow, said first plow wing having a curved inner edge which generally corresponds to a curve of said material engaging surface of said center plow such that said curved inner edge at least partially engages said curved material engaging surface of said center plow to provide a substantially continuous material engaging surface when said first plow wing is in said angled position.

60. The plow assembly of claim 59, wherein said first plow wing is pivotally mounted on said first end of said center plow via a hinge member that is positioned generally rearward of said curved material engaging surfaces of said first plow wing and said center plow.

* * * * *

UNITED STATES PATENT AND TRADEMARK OFFICE

CERTIFICATE OF CORRECTION

PATENT NO. : 7,134,227 B2
APPLICATION NO. : 10/835429
DATED : November 14, 2006
INVENTOR(S) : Philip J. Quenzi et al.

It is certified that error appears in the above-identified patent and that said Letters Patent is hereby corrected as shown below:

Column 27, line 9, Claim 1 reads: "at least one connected member connected between said"; it should read -- at least one connecting member connected between said --.

Column 28, line 43, Claim 16 reads: "pivotal between an angled position where said plow"; it should read -- pivotal between an angled position, where said plow --.

Column 31, line 28, Claim 31 reads: "wherein said actuating system includes at least one glow"; it should read -- wherein said actuating system includes at least one plow --.

Column 31, line 63, Claim 33 reads: "positions, said actuating system urging said first slow"; it should read -- positions, said actuating system urging said first plow --.

Column 32, line 58, Claim 38 reads: "positions said actuating system urging said first plow"; it should read -- positions, said actuating system urging said first plow --.

Column 34, line 46, Claim 45 reads: "engaging surface of said center plow such tat said"; it should read -- engaging surface of said center plow such that said --.

Column 35, line 25, Claim 47 reads: "to said fist pressure being applied to said second wing"; it should read -- to said first pressure being applied to said second wing --.

Signed and Sealed this

Eighteenth Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,134,227 B2
APPLICATION NO. : 10/835429
DATED : November 14, 2006
INVENTOR(S) : Philip J. Quenzi et al.

It is certified that error appears in the above-identified patent and that said Letters Patent is hereby corrected as shown below:

Claim 21, Column 29, lines 13-16 read: "21. The plow assembly of claim 19, wherein said pin is selectively insertable through one of at least two openings at said center plow to selectively mount said biasing member at said center plow." Lines 13-16 should read: -- 21. The plow assembly of claim 16, wherein said first plow wing is pivotable toward said aligned position in response to a load against said first plow wing in a direction generally along said center plow at least when said center plow is angled toward said first position. --.

Claim 33, Column 32, lines 8-17 read: "wherein said actuating system is operable to apply an aligning pressure to said first wing actuator to urge said first plow wing toward said aligned position, said aligning pressure being greater than a plow pressure applied to said at least one plow actuator to pivot said center plow between said first and center positions; and wherein said aligning pressure is applied to said first wing actuator after said center plow is substantially urged toward said one of said first position and a position between said first and center positions." Lines 8-17 should read: -- wherein said at least one plow actuator is operable to urge said center plow toward said first position in response to a first pressure and said first wing actuator is operable to urge said first plow wing toward said aligned position in response to a second pressure, said second pressure being greater than said first pressure. --.

Claim 35, Column 32, line 25 reads: "one valve restricts flow of fluid from said first wing actuator". Line 25 should read: -- one valve restricts fluid flow toward said first wing actuator --.

Claim 41, Column 33, line 43 reads: "tion and said aligned position in response to said center". Line 43 should read: -- tion and said aligned position, said actuating system being operable to urge said second plow wing toward said aligned position in response to said center --.

Signed and Sealed this
Twenty-ninth Day of May, 2012

David J. Kappos

David J. Kappos
*Director of the United States Patent and Trademark Office*